US007864205B2

(12) United States Patent
Yokozawa

(10) Patent No.: US 7,864,205 B2
(45) Date of Patent: Jan. 4, 2011

(54) HEAT-SENSITIVE TRANSFER IMAGE-FORMING METHOD

(75) Inventor: Akito Yokozawa, Minami-ashigara (JP)

(73) Assignee: Fujifilm Corporation, Tokyo (JP)

( * ) Notice: Subject to any disclaimer, the term of this patent is extended or adjusted under 35 U.S.C. 154(b) by 188 days.

(21) Appl. No.: 12/360,586

(22) Filed: Jan. 27, 2009

(65) Prior Publication Data

US 2009/0189968 A1 Jul. 30, 2009

(30) Foreign Application Priority Data

Jan. 30, 2008 (JP) ..... 2008-019857

(51) Int. Cl.
*B41M 5/382* (2006.01)
*B41M 5/40* (2006.01)
*B41M 5/50* (2006.01)
*B41J 2/32* (2006.01)

(52) U.S. Cl. ..... 347/171; 347/217; 347/221

(58) Field of Classification Search ..... 347/221, 347/171, 217; 428/32.39, 32.5, 32.67
See application file for complete search history.

(56) References Cited

U.S. PATENT DOCUMENTS 7,381,685 B2 * 6/2008 Oguma et al. ..... 503/227
7,786,039 B2 * 8/2010 Koide et al. ..... 503/227
7,790,346 B2 * 9/2010 Irita ..... 430/200
2009/0087598 A1 * 4/2009 Yokozawa ..... 428/32.52
2009/0195633 A1 * 8/2009 Shirai et al. ..... 347/213

FOREIGN PATENT DOCUMENTS

JP 6-171240 A 6/1994
JP 8-25813 A 1/1996
JP 8-90945 A 4/1996
JP 11-321128 A 11/1999

* cited by examiner

*Primary Examiner*—Huan H Tran
(74) *Attorney, Agent, or Firm*—Sughrue Mion, PLLC

(57) ABSTRACT

A heat-sensitive transfer image forming method, containing: superposing receptor layer side of image-receiving sheet and dye layer side of ink sheet, making a thermal head contact with the sheets from lubricating layer side of ink sheet, and applying heat while making the head and ink sheet move at 60 mm/s or more relatively, and thereby transferring dye to form an image; wherein image-receiving sheet has heat insulation layer containing hollow polymer particles, receptor layer and/or heat insulation layer contains a water-soluble polymer; lubricating layer contains inorganic particles in 0.01-5 mass % to the total solid content of lubricating layer, the particles have Mohs' hardness 3-6 and mean particle size 0.3-5 μm, and the ratio of the maximum width of each particles to the sphere equivalent diameter thereof is 1.5-50; and when 0.7 J/cm$^2$ energy is applied, contact distance between the head and lubricating layer is 350-450 μm.

4 Claims, No Drawings

HEAT-SENSITIVE TRANSFER IMAGE-FORMING METHOD

FIELD OF THE INVENTION

The present invention relates to a heat-sensitive transfer image forming method. In more detail, the present invention relates to a heat-sensitive transfer image forming method that uses a particular heat-sensitive transfer image-receiving sheet and a particular heat-sensitive transfer sheet, and specifies a contact distance between a thermal head and the heat-sensitive transfer sheet, thereby a stable and high quality image is provided in a high speed printing, and a stain adhered to the thermal head is reduced at the same time.

BACKGROUND OF THE INVENTION

Various heat transfer recording methods have been known so far. Among these methods, dye diffusion transfer recording systems attract attention as a process that can produce a color hard copy having an image quality closest to that of silver halide photography. Moreover, this system has advantages over silver halide photography: it is a dry system, it enables direct visualization from digital data, it makes reproduction simple, and the like.

In the dye diffusion transfer recording systems, a colorant (hereinafter also referred to as "a dye" or "an ink")-containing heat-sensitive transfer sheet (hereinafter also simply referred to as "an ink sheet") and a heat-sensitive transfer image-receiving sheet (hereinafter also simply referred to as "an image-receiving sheet") are superposed, and the ink sheet is heated using a thermal head with which heat generation can be controlled by electric signals. Thereby a colorant in the ink sheet is transferred to the image-receiving sheet to record image information. More specifically, a transferred color image with a continuous change in color shading can be obtained by recording three colors including cyan, magenta and yellow, in the manner of one over another.

Recently, in the field of the dye diffusion transfer recording system, a variety of printers capable of printing at higher speed than old type printers have been developed and are spreading in the market. For example, the Printer ASK 2000 (trade name, manufactured by FUJIFILM Corporation), whose printing time per sheet is as short as the degree of about 8 seconds, contributes to a short cut of customer's waiting time in a shop.

In the heat-sensitive transfer image-receiving sheet of this system, a receptor layer is disposed on a support, and further a heat insulation layer may be disposed between the receptor layer and the support. The receptor layer is disposed to take therein a dye transferred from an ink sheet, thereby coloring the receptor layer. By a heat insulating effect given to the heat insulation layer, heat applied from a thermal head is remained therein. Migration of the dye is accelerated by the heat insulation layer so that a transferred dye density can be enhanced.

For this reason, for example, hollow polymer particles are used in the heat insulation layer, and various kinds of solutions are proposed to effectively enhance both heat insulating effect and cushion property owing to the hollow polymer particles (see, e.g., JP-A-8-25813 ("JP-A" means unexamined published Japanese patent application), JP-A-11-321128, and JP-A-6-171240).

Beside, it is known that the ink sheet may have a heat-resistant lubricating layer on a surface of the support (so-called back surface) opposite to the side of the thermal transfer layer containing a dye, and an inorganic filler is incorporated in the heat-resistant lubricating layer (see, e.g., JP-A-8-90945).

However, it is not always possible to obtain high quality prints stably in a recent high-speed printing. Therefore, it has been desired to develop an image forming method suitable for the high-speed printing.

SUMMARY OF THE INVENTION

The present invention resides in a heat-sensitive transfer image forming method, the method comprising: providing a heat-sensitive transfer image-receiving sheet having a heat insulation layer and a receptor layer on one surface of a support and a heat-sensitive transfer sheet having a heat-sensitive transfer layer containing a dye on one surface of a support and a heat resistant lubricating layer on another surface of the support; superposing the heat-sensitive transfer image-receiving sheet and the heat-sensitive transfer sheet so that the receptor layer and the heat-sensitive transfer layer contact with each other; making a thermal head contact with the superposed sheets from the heat resistant lubricating layer side; and applying heat from the thermal head to the heat-sensitive transfer sheet, while making the thermal head and the heat-sensitive transfer sheet move at a relative speed of 60 mm/sec. or more, and thereby transferring the dye from the heat-sensitive transfer layer to the receptor layer to form an image;

wherein, in the heat-sensitive transfer image-receiving sheet, the heat insulation layer contains hollow polymer particles, and at least one of the receptor layer and the heat insulation layer contains a water-soluble polymer;

wherein, in the heat-sensitive transfer sheet, the heat resistant lubricating layer contains inorganic particles in an amount of 0.01% by mass to 5% by mass with respect to the total solid content of the heat resistant lubricating layer, wherein the inorganic particles have Mohs' hardness of 3 to 6 and a mean particle size of 0.3 to 5 μm, and the ratio of the maximum width of each of the inorganic particles to the sphere equivalent diameter thereof is from 1.5 to 50; and wherein, when 0.7 J/cm$^2$ of energy is applied to the thermal head, the contact distance between the thermal head and the heat resistant lubricating layer is from 350 to 450 μm.

Other and further features and advantages of the invention will appear more fully from the following description.

DETAILED DESCRIPTION OF THE INVENTION

According to the present invention, there is provided the following means:

(1) A heat-sensitive transfer image forming method, the method comprising: providing a heat-sensitive transfer image-receiving sheet having a heat insulation layer and a receptor layer on one surface of a support and a heat-sensitive transfer sheet having a heat-sensitive transfer layer containing a dye on one surface of a support and a heat resistant lubricating layer on another surface of the support; superposing the heat-sensitive transfer image-receiving sheet and the heat-sensitive transfer sheet so that the receptor layer and the heat-sensitive transfer layer contact with each other; making a thermal head contact with the superposed sheets from the heat resistant lubricating layer side; and applying heat from the thermal head to the heat-sensitive transfer sheet, while making the thermal head and the heat-sensitive transfer sheet move at a relative speed of 60 mm/sec. or more, and thereby transferring the dye from the heat-sensitive transfer layer to the receptor layer to form an image;

wherein, in the heat-sensitive transfer image-receiving sheet, the heat insulation layer contains hollow polymer particles, and at least one of the receptor layer and the heat insulation layer contains a water-soluble polymer;

wherein, in the heat-sensitive transfer sheet, the heat resistant lubricating layer contains inorganic particles in an amount of 0.01% by mass to 5% by mass with respect to the total solid content of the heat resistant lubricating layer, wherein the inorganic particles have Mohs' hardness of 3 to 6 and a mean particle size of 0.3 to 5 μm, and the ratio of the maximum width of each of the inorganic particles to the sphere equivalent diameter thereof is from 1.5 to 50; and wherein, when 0.7 J/cm$^2$ of energy is applied to the thermal head, the contact distance between the thermal head and the heat resistant lubricating layer is from 350 to 450 μm.

(2) The heat-sensitive transfer image forming method according to the above item (1), wherein the difference in the contact distance between the case where 0.7 J/cm$^2$ of energy is applied to the thermal head and the case where none of energy is applied to the thermal head is from 40 to 100 μm.

(3) The heat-sensitive transfer image forming method according to the above item (1) or (2), wherein the heat-sensitive transfer sheet has a thermal transfer layer containing a yellow dye, a thermal transfer layer containing a magenta dye, and a thermal transfer layer containing a cyan dye on the support at a position thereof different from each other, and the print speed of the dye in each of the thermal transfer layers is 80 mm/sec. or more.

(4) The heat-sensitive transfer image forming method according to any one of the above items (1) to (3), wherein the inorganic particle contained in the heat resistant lubricating layer is magnesium oxide.

As a result of analysis of the problems arising from the high-speed printing, we have found that image disappearance is affected by a wide variety of printer fixation, thereby sometimes to become worse. Further, we have found that an amount of the stain adhered to a thermal head becomes larger by some methods for improvement of the image disappearance, so that scars sometimes generate in a print copy. Furthermore, we have found that a protective layer disposed at the heating element surface of the thermal head erodes by the action of a thermal reaction, thereby to cause disconnection, and as a result, streaks that are print-failure portions sometimes generate in a print copy. Consequently, we have found that a problem is caused by the necessity of frequent exchange for the thermal head in a short time.

The present invention will be explained in detail below.

1) High-speed printer and Contact distance between thermal head and heat resistant lubricating layer The heat-sensitive transfer image forming method of the present invention may be suitably used for a high-speed printer. The high-speed printer is a printer having a print speed of 60 mm/sec. or more with respect to the dye-containing thermal transfer layer of the ink sheet. In the present invention, the print speed is preferably 80 mm/sec. or more, and most preferably 100 mm/sec. or more. As the thermal head, there are a dot-type and a line-type. In the present invention, it is especially preferred to use a line-type thermal head. The line-type thermal head is detailed below. For example, when the line-type thermal head of 300 dpi (dot number per inch) is used, the printing time of 60 mm per sec. is equivalent to 1.4 milliseconds, and likewise the printing time of 80 mm per sec. is equivalent to 1.1 milliseconds, and the printing time of 100 mm per sec. is equivalent to 0.8 milliseconds, in terms of printing time per line.

The line-type thermal head has a structure swollen in the form of arc on the thermal head substrate. The heating unit is located at the part of the swollen structure. An electric resistor that is used in the heating unit generates heat, when an electric current is sent to the electric resistor by applying a driver IC control voltage.

In the high-speed printer, the thermal head contacts a heat resistant lubricating layer of the ink sheet. A heat-sensitive transfer layer containing a dye that is disposed on the surface opposite to the heat resistant lubricating layer contacts the surface of the heat-sensitive transfer image-receiving sheet at the receptor layer side. The surface opposite to the receptor layer side of the heat-sensitive transfer image-receiving sheet contacts members of the printer. Pressure is applied between the thermal head and the printer member, and thereby the swollen part of the thermal head forces the ink sheet, and changes its shape and contacts the ink sheet. Then, the forced ink sheet forces the heat-sensitive transfer image-receiving sheet and changes its shape and contacts the heat-sensitive transfer image-receiving sheet. Further, as described above, energy is applied by sending an electric current to the thermal head to generate heat. Thereby printing is performed. As the printer member, for example, an elastic platen roller is used. Corresponding to rotation of the platen roller at the above-described conditions, the ink sheet and the heat-sensitive transfer image-receiving sheet move at the same speed with respect to the thermal head, while these sheets adhere to each other. Thereby printing is successively performed. As seen from the above explanation, the high-speed printer is designed so that the thermal head and the heat resistant lubricating layer contact at a relative speed different from each other at the time of printing. The thermal head contacts the heat resistant lubricating layer at the part of the head having an arc-shaped projection structure, and therefore the more the thermal head deeply gets into the heat resistant lubricating layer, the more they become to contact with each other over the long distance. The higher temperature the thermal head is, the higher temperature both the ink sheet and the heat-sensitive transfer image-receiving sheet contacting with each other also become, and they become to change their shape more easily. Resultantly, the thermal head more deeply gets into the heat resistant lubricating layer, and thereby they become to contact with each other over the longer distance.

A method of measurement for a contact distance between the thermal head and the heat resistant lubricating layer will be described below.

The surface of the thermal head of the high-speed printer is colored by using a marker and the like. After setting an ink sheet and a heat-sensitive transfer image-receiving sheet in the high-speed printer, energy is applied uniformly to the thermal head. Then, a dye-containing heat-sensitive transfer layer of the ink sheet is once subjected to printing. A surrounding environment at the time of printing is set up to the conditions of temperature ranging from 22° C. to 28° C. and the relative humidity ranging from 40% to 70%. Having taken out the thermal head from the printer after completion of printing operation, the thermal head is inspected with an optical micrometer. The region in which the marker is rubbed off and discolored is defined as a contact region of the thermal head and the heat resistant lubricating layer. However, the following proviso is added. In order to make the heat-sensitive transfer image-receiving sheet be set within the printing region, even though the image-receiving sheet slides into the width direction, the width of a heater of the line-type thermal head in the line direction and the width of the ink sheet are generally designed so as to become longer than the width of the image-receiving sheet. Accordingly, the areas (portions)

at which the ink sheet and the image-receiving sheet do not contact with each other but, the thermal head and the ink sheet contact with each other, exist at both ends in the width direction. Therefore, the aforementioned areas are omitted from the contact region. The length of the contact region at the direction in which the thermal head moves relatively to a heat resistant lubricating layer of the ink sheet is obtained by dividing an area of the contact region by the width of the image-receiving sheet. The thus-calculated length is defined as a contact distance between the thermal head and the heat resistant lubricating layer.

In the case where the friction property between the thermal head and the heat resistant lubricating layer substantially changes by coloring with a marker or the like over the whole surface of the thermal head, it is necessary to color with a marker or the like only a limited surface of the thermal head so that the friction property between the thermal head and the heat resistant lubricating layer does not changes substantially. In this case, the contact region of the thermal head and the heat resistant lubricating layer means the region in which the coloring has been rubbed off and discolored by printing in the range colored with a marker or the like before printing. The contact distance between the thermal head and the heat resistant lubricating layer is obtained by dividing the area of the contact region by the length of the contact region at the line direction of the thermal head. In the case where the contact distance between the thermal head and the heat resistant lubricating layer is measured by coloring a part area of the thermal head, the contact distance sometimes changes depending on the position of the thermal head in the line direction thereof. Therefore, the contact distance is measured at least three positions including the left, the right and the center with respect to the line direction of the thermal head. The mean value of the contact distances is defined as a contact distance between the thermal head and the heat resistant lubricating layer.

The marker that is used to mark the surface of the thermal head is required to be heat resistant. Specifically, heat resistant and weather resistant marker RED (trade name, manufactured by Okitsumo Incorporated) may be used.

The contact distance between the thermal head and the heat resistant lubricating layer can be measured by modulating energy that is applied to the thermal head by an electric current that is supplied to the thermal head, and thereby the contact distance is measured in accordance with each of applied energy.

In the present invention, it is necessary that the contact distance between the thermal head and the heat resistant lubricating layer, in the case where the applied energy is 0.7 J/cm$^2$, be in the range of 350 μm to 450 μm, and most preferably from 360 μm to 440 μm.

When the contact distance between the thermal head and the heat resistant lubricating layer, in the case where the applied energy is 0.7 J/cm$^2$, is longer than the aforementioned range, a stain of the thermal head becomes to increase. In contrast, when the contact distance is shorter than the aforementioned range, disappearance of the image is worsened by a variability of the printer setting, specifically the case where a relative position of the thermal head and the platen roller shifts by about 0.1 mm. As the cause of the image disappearance, it is supposed that a heating element (portion) of the thermal head becomes near the end of the contact region owing to the shift of the position, and a part or the whole of the heating element become out of the contact region owing to a minor deviation at the time of printing, and scattering of heat conduction is caused thereby.

It is preferable that the difference between 0.7 J/cm$^2$ and none of the applied energy in terms of the contact distance between the thermal head and the heat resistant lubricating layer is from 40 μm to 100 μm and most preferably 50 μm to 90 μm.

It is considered that the contact distance between the thermal head and the heat resistant lubricating layer becomes longer by making the thermal head easy to force owing to the improvement in a cushion property of the heat-sensitive transfer image-receiving sheet. As a method of evaluating the cushion property of the heat-sensitive transfer image-receiving sheet, an indentation hardness test of measuring an amount of indentation by applying a load to a specific indenting tool is known such as Brinell hardness test, Vickers hardness test and Rockwell hardness test. However, the conditions for these tests are different from those of the high-speed printing in which a thermal head is pressed at a high pressure for a short time. Specifically, it is impossible in these indentation hardness tests to reproduce both the temperature distribution of the heat-sensitive transfer image-receiving sheet to which a quantity of heat is given at a high temperature for a short time in the high-speed printing and the conditions at which the heat-sensitive transfer image-receiving sheet is placed only for a short time at such high temperature that components of the image-receiving sheet are dissolved or heat-decomposed. Further, we have found that the contact distance between the thermal head and the heat resistant lubricating layer varies depending on the combination of an ink sheet and a heat-sensitive transfer image-receiving sheet. Therefore, it is not possible to define the contact distance by solely using the cushion property of the heat-sensitive transfer image-receiving sheet.

A heat-sensitive transfer image-receiving sheet and an ink sheet used in the present invention will be described in detail hereinafter.

2) Heat-sensitive transfer image-receiving sheet (hereinafter also referred to merely as an image-receiving sheet)

The image-receiving sheet that can be used in the present invention has a sheet having a support, at least one dye-receptor layer (hereinafter also referred to merely as a receptor layer) over the support, and at least one heat insulating layer containing hollow polymer particles between the support and the receptor layer. It is required that at least one of the receptor layer and the heat insulation layer contains a water-soluble polymer. Further, between the support and the receptor layer, there may be formed an interlayer having various functions such as white back ground controlling, antistatic, adhesion, and leveling functions. Further, a release layer may be formed at the outermost layer on the side of which a heat-sensitive transfer sheet is superposed.

In the present invention, it is preferred that at least one of the receptor layer, the heat insulation layer and the interlayer be coated with using an aqueous type coating liquid. Coating of each layer may be performed by an ordinary method such as roll coat, bar coat, gravure coat, gravure reverse coat, die coat, slide coat, and curtain coat. Each of the receptor layer, the heat insulation layer and the interlayer may be coated individually, or an arbitrary combination of these layers may be simultaneously multilayer coated.

On the side of the support opposite to the receptor layer coating side, a curl adjusting layer, a recording layer or a static adjusting layer may be disposed.

(Polymer in the Receptor Layer)

The heat-sensitive transfer image-receiving sheet used in the present invention has at least one receptor layer having a thermoplastic receptive polymer capable of receiving at least a dye.

Examples of preferable receptive polymers include vinyl-based resins such as polyvinyl acetate, ethylene vinyl acetate copolymer, vinyl chloride vinyl acetate copolymer, vinyl chloride acrylate copolymer, vinyl chloride methacrylate copolymer, polyacrylic ester, polystyrene, and acrylic polystyrene; acetal resins such as polyvinyl formal, polyvinyl butyral, and polyvinyl acetal; polyester resins such as polyethyleneterephthalate, polybutyleneterephthalate and polycaprolactone; polycarbonate-based resins; polyurethane-based resins; cellulose-based resins; polyolefin-based resins such as polypropylene; and polyamide-based resins such as urea resins, melamine resins and benzoguanamine resins. These resins may be used optionally blending with each other in the range of compatibility.

It is further preferable, among these polymers, to use a polycarbonate, a polyester, a polyurethane, a polyvinyl chloride or a copolymer of vinyl chloride, a styrene-acrylonitrile copolymer, a polycaprolactone or a mixture of two or more of these. It is particularly preferable to use a polyester, a polyvinyl chloride or a copolymer of vinyl chloride, or a mixture of these.

The above-exemplified polymers may be dissolved in a proper organic solvent such as methyl ethyl ketone, ethyl acetate, benzene, toluene, and xylene so that they can be coated on a support. Alternatively, they may be added to a water-based coating liquid as latex polymer so that they can be coated on a support. Preferably, they are used as latex polymer in the aqueous type coating.

The latex polymer for use in the receptor layer is a dispersion in which water-insoluble hydrophobic polymers are dispersed as fine particles in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. The dispersed particles preferably have a mean average particle size (diameter) of about 1 to 50,000 nm, more preferably about 5 to 1,000 nm.

In the case where a plurality of latex polymer is contained as a mixture in the same layer, the glass transfer temperature (Tg) of the latex polymer in the same layer is indicated as a weight average value of each of the glass transfer temperature value with respect to the content by mass of each of the latex polymer.

In order to adjust the contact distance between the thermal head and the heat resistant lubricating layer so as to enter within the specific range of the present invention, the glass transfer temperature (Tg) of the latex polymer is preferably from −30° C. to 100° C., more preferably from 0° C. to 80° C., still more preferably from 10° C. to 70° C., and especially preferably from 15° C. to 60° C. Further, the latex polymer may be contained in a plurality of layers, and the latex polymer having a different glass transfer temperature from each other may be contained in the plurality of layers.

In a preferable embodiment of the latex polymer used in the heat-sensitive transfer image-receiving sheet according to the present invention, latex polymers such as acrylic-series polymers, polyesters, rubbers (e.g., SBR resins), polyurethanes, polyvinyl chloride copolymers including copolymers such as vinyl chloride/vinyl acetate copolymer, vinyl chloride/acrylate copolymer, and vinyl chloride/methacrylate copolymer; polyvinyl acetate copolymers including copolymers such as ethylene/vinyl acetate copolymer; and polyolefins, are preferably used. These latex polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number-average molecular weight.

The latex polymer according to the present invention is preferably exemplified by any one of polyester latexes; vinyl chloride latex copolymers such as vinyl chloride/acrylic compound latex copolymer, vinyl chloride/vinyl acetate latex copolymer, and vinyl chloride/vinyl acetate/acrylic compound latex copolymer, or arbitrary combinations thereof.

Examples of the vinyl chloride copolymer include those described above. Among these, VINYBLAN 240, VINYBLAN 270, VINYBLAN 276, VINYBLAN 277, VINYBLAN 375, VINYBLAN 380, VINYBLAN 386, VINYBLAN 410, VINYBLAN 430, VINYBLAN 432, VINYBLAN 550, VINYBLAN 601, VINYBLAN 602, VINYBLAN 609, VINYBLAN 619, VINYBLAN 680, VINYBLAN 680S, VINYBLAN 681N, VINYBLAN 683, VINYBLAN 685R, VINYBLAN 690, VINYBLAN 860, VINYBLAN 863, VINYBLAN 865, VINYBLAN 867, VINYBLAN 900, VINYBLAN 938 and VINYBLAN 950 (trade names, manufactured by Nissin Chemical Industry Co., Ltd.); and SE1320, S-830 (trade names, manufactured by Sumica Chemtex) are preferable.

The polyester-series latex that can be used as a latex polymer is preferably exemplified by VIRONAL MD1200, VIRONAL MD1220, VIRONAL MD1245, VIRONAL MD 1250, VIRONAL MD 1500, VIRONAL MD1930, and VIRONAL MD1985 (trade names, manufactured by Toyobo Co., Ltd.).

Among these, vinyl chloride-series latex copolymers such as a vinyl chloride/acrylic compound latex copolymer, a vinyl chloride/vinyl acetate latex copolymer, a vinyl chloride/vinyl acetate/acrylic compound latex copolymer, are more preferable.

Further, the receptor layer may contain sliding agents, and antioxidants.

<Water-soluble Polymer>

In order that a heat insulating effect owing to the hollow polymer particles in the heat insulation layer described below can be achieved in the present invention, it is necessary to incorporate a water-soluble polymer in any one of a receptor layer and a heat insulation layer of the heat-sensitive transfer image-receiving sheet. It is preferable that a water-soluble polymer is contained in at least one receptor layer. It is most preferable that a water-soluble polymer is contained in both the receptor layer and the heat insulation layer. When an interlayer is disposed between these layers, it is a furthermore preferable embodiment that the water-soluble polymer is also contained in the interlayer. The water-soluble polymer that is contained in the receptor layer is explained below.

Herein, the "water-soluble polymer" means a polymer which dissolves, in 100 g of water at 20° C., in an amount of preferably 0.05 g or more, more preferably 0.1 g or more, further preferably 0.5 g or more, and particularly preferably 1 g or more. As the water-soluble polymers, natural polymers, semi-synthetic polymers and synthetic polymers are preferably used. These polymers may be used either singly or as a mixture thereof.

Among the water-soluble polymer that can be used in the heat-sensitive transfer image-receiving sheet in the present invention, the natural polymers and the semi-synthetic polymers will be explained in detail. Specific examples include the following polymers: plant type polysaccharides such as κ-carrageenans, ι-carrageenans, λ-carrageenans, and pectins; microbial type polysaccharides such as xanthan gums and dextrins; animal type natural polymers such as gelatins and caseins; and cellulose-based polymers such as carboxymethylcelluloses, hydroxyethylcelluloses, and hydroxypropylcelluloses.

Of the natural polymers and the semi-synthetic polymers that can be used in the present invention, gelatin is preferred. Gelatin having a molecular mass of from 10,000 to 1,000,000 may be used in the present invention. Gelatin that can be used in the present invention may contain an anion such as $Cl^-$ and $SO_4^{2-}$, or alternatively a cation such as $Fe^{2+}$, $Ca^{2+}$, $Mg^{2+}$, $Sn^{2+}$, and $Zn^{2+}$. Gelatin is preferably added as an aqueous solution.

Of the water-soluble polymers that can be used in the heat-sensitive transfer image-receiving sheet in the present invention, examples of the synthetic polymers include polyvinyl pyrrolidone, polyvinyl pyrrolidone copolymers, polyvinyl alcohol, polyethylene glycol, polypropylene glycol, and water-soluble polyesters. Among the synthetic polymers that can be used in the present invention, polyvinyl alcohols are preferable.

As the polyvinyl alcohol, there can be used various kinds of polyvinyl alcohols such as complete saponification products thereof, partial saponification products thereof, and modified polyvinyl alcohols. With respect to these polyvinyl alcohols, those described in Koichi Nagano, et al., "Poval", Kobunshi Kankokai, Inc. are useful.

The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For example, a coated-surface quality can be improved by an addition of boric acid, and the addition of boric acid is preferable. The amount of boric acid to be added is preferably 0.01 to 40 mass %, with respect to polyvinyl alcohol.

Specific examples of the polyvinyl alcohols include completely saponificated polyvinyl alcohol such as PVA-105, PVA-110, PVA-117 and PVA-117H (trade names, manufactured by KURARAY CO., LTD.); partially saponificated polyvinyl alcohol such as PVA-203, PVA-205, PVA-210 and PVA-220 (trade names, manufactured by KURARAY CO., LTD.); and modified polyvinyl alcohols such as C-118, HL-12E, KL-118 and MP-203 (trade names, manufactured by KURARAY CO., LTD.).

A preferable addition amount of the latex polymer is in the range of from 50% by mass to 99.5% by mass, more preferably from 70% by mass to 99% by mass, in terms of solid content of the latex polymer in the receptor layer.

In the heat-sensitive transfer image-receiving sheet used in the present invention, at least one receptor layer may be coated with an aqueous type coating liquid. In the case where the image-receiving sheet has a plurality of receptor layers, it is preferred to coat all of these layers with an aqueous type coating liquid, followed by drying for production. The "aqueous type" here means that 60% by mass or more of the solvent (dispersion medium) of the coating liquid is water. As a component other than water in the coating liquid, a water miscible organic solvent may be used. Examples thereof include methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

The coating amount of the receptor layer is preferably 0.5 to 10 g/m$^2$ (solid basis, hereinafter, the amount to be applied in the present specification means a value on solid basis, unless otherwise specified). The film thickness of the receptor layer is preferably in the range of from 1 μm to 20 μm.

<Release Agent>

To the heat-sensitive transfer image-receiving sheet used in the present invention, a release agent may be added to secure a releasing property between the heat-sensitive transfer sheet and the heat-sensitive transfer image-receiving sheet at the time of image printing.

As the release agent, there can be used, for example, solid waxes such as polyethylene wax, paraffin wax, fatty acid ester wax, and amide wax; and silicone oil, phosphoric ester-based compounds, fluorine-based surfactants, silicone-based surfactants, and other release agents known in this technical field. Of these release agents, preferred are fatty acid ester waxes, fluorine-based surfactants, and silicone-based compounds such as silicone-based surfactants, silicone oil and/or hardened products thereof.

(Heat Insulation Layer)

The heat insulation layer that is coated in the heat-sensitive transfer image-receiving sheet used in the present invention may be a single layer or double or more multiple layers. The heat insulation layer(s) is disposed between the support and the receptor layer and it is required that at least one heat insulation layer contains hollow polymer particles.

The hollow polymer particles in the present invention are polymer particles having voids inside of the particles. The hollow polymer particles are preferably aqueous dispersion. Examples of the hollow polymer particles include (1) non-foaming type hollow particles obtained in the following manner: a dispersion medium such as water is contained inside of a capsule wall formed of a polystyrene, acrylic resin, or styrene/acrylic resin, and, after a coating liquid is applied and dried, the water in the particles is vaporized out of the particles, with the result that the inside of each particle forms a hollow; (2) foaming type microballoons obtained in the following manner: a low-boiling-point liquid such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling-point liquid inside of the particles, whereby the inside of each particle is made to be hollow; and (3) microballoons obtained by foaming the above (2) under heating in advance, to make hollow polymer particles.

Of these, non-foaming hollow polymer particles of the foregoing (1) are preferred. If necessary, use can be made of a mixture of two or more kinds of polymer particles. Specific examples include Rohpake 1055, manufactured by Rohm and Haas Co.; Boncoat PP-1000, manufactured by Dainippon Ink and Chemicals, Incorporated; SX866(B), manufactured by JSR Corporation; and Nippol MH5055, manufactured by Nippon Zeon (all of these product names are trade names).

The glass transition temperature (Tg) of the hollow polymer particles is preferably 70 to 200° C., more preferably 90 to 180° C. The average particle diameter (particle size) of the hollow polymer particles is preferably 0.1 to 5.0 μm, more preferably 0.2 to 3.0 μm, and particularly preferably 0.3 to 1.5 μm. The hollow ratio (percentage of void) of the hollow polymer particles is preferably in the range of from about 20% to about 70%, and particularly preferably from 20% to 60%.

In the present invention, the particle size of the hollow polymer particle is calculated after measurement of the circle-equivalent diameter of the periphery of particle under a transmission electron microscope. The average particle diameter is determined by measuring the circle-equivalent diameter of the periphery of at least 300 hollow polymer particles observed under the transmission electron microscope and obtaining the average thereof.

The hollow ratio of the hollow polymer particles is calculated by the ratio of the volume of voids to the volume of a particle.

It is necessary to incorporate a water-soluble polymer in any one of a receptor layer and a heat insulation layer of the heat-sensitive transfer image-receiving sheet that is used in the present invention. The water-soluble polymer is preferably contained in at least one heat insulation layer. It is one of the most preferable embodiments that the water-soluble polymer is contained in both the receptor layer and the heat insulation layer.

A preferable water-soluble polymer that is contained as a binder in addition to hollow polymer particles in the heat insulation layer is exemplified by water-soluble polymers described in the section of Receptor layer. Among these water-soluble polymers, gelatin and a polyvinyl alcohol are more preferable. These resins may be used either singly or as a mixture thereof.

A thickness of the heat insulation layer containing the hollow polymer particles is preferably from 5 to 50 μm, more preferably from 5 to 40 μm.

(Interlayer)

An interlayer may be formed between the receptive layer and the support. A function of the interlayer is exemplified by white background adjustment, antistatic, imparting of adhesion and imparting of smoothness (leveling). The function of the interlayer is not limited to these, and a previously known interlayer may be provided. The plural interlayer may be formed. For example, it is also preferable embodiment to form two interlayers such as one interlayer between the heat insulation layer and the support and the other interlayer between the receptor layer and the heat insulation layer.

In addition to the aforementioned functions of the interlayer that is disposed between the receptor layer and the heat insulation layer, as a preferable embodiment, there are exemplified functions such as a function of intercepting a reverse influence of an organic solvent to the hollow polymer particles in the heat insulation layer in the case where the organic solvent is contained in a receptor layer-coating liquid and a function of achieving both a dye receptor effect and a heat insulating effect by incorporating both a thermoplastic receptor latex polymer, that is capable of receiving a dye, and hollow polymer particles.

It is preferred that the interlayer contains a water-soluble polymer as a binder in addition to hollow polymer particles. A preferable water-soluble polymer is exemplified by water-soluble polymers described in the section of Receptor layer. Among these water-soluble polymers, gelatin and a polyvinyl alcohol are more preferable. These resins may be used either singly or as a mixture thereof.

<Crosslinking Agent>

In the present invention, the crosslinking agent may be used as a crosslinking agent (hereinafter also referred to hardener) capable of crosslinking a water-soluble polymer. A crosslinking agent may be added to a coating layer of the image-receiving sheet, such as a receptive layer, a heat-insulating layer, and an interlayer.

Preferable examples of the crosslinking agent that can be used in the present invention include H-1, 4, 6, 8, and 14 in JP-A-1-214845 in page 17; compounds (H-1 to H-54) represented by one of formulae (VII) to (XII) in U.S. Pat. No. 4,618,573, columns 13 to 23; compounds (H-1 to H-76) represented by formula (6) in JP-A-2-214852, page 8, the lower right (particularly, H-14); and compounds described in claim 1 in U.S. Pat. No. 3,325,287. Examples of the crosslinking agent include crosslinking agents described, for example, in U.S. Pat. No. 4,678,739, column 41, U.S. Pat. No. 4,791,042, JP-A-59-116655, JP-A-62-245261, JP-A-61-18942, and JP-A-4-218044. More specifically, an aldehyde-series crosslinking agent (formaldehyde, etc.), an aziridine-series crosslinking agent, an epoxy-series crosslinking agent, a vinyl sulfone-series crosslinking agent (N,N'-ethylene-bis (vinylsulfonylacetamido)ethane, etc.), an N-methylol-series crosslinking agent (dimethylol urea, etc.), a boric acid, a metaboric acid, or a polymer crosslinking agent (compounds described, for example, in JP-A-62-234157), can be mentioned.

Preferable examples of the crosslinking agent include a vinylsulfone-series crosslinking agent and chlorotriazines.

These crosslinking agents are used in an amount of generally 0.001 to 1 g, preferably 0.005 to 0.5 g, per g of the water-soluble polymer.

<Ultraviolet Absorbent>

The heat-sensitive transfer image-receiving sheet used in the present invention may contain any ultraviolet absorbents. As the ultraviolet absorbents, use can be made of conventionally known inorganic or organic ultraviolet absorbents. As the organic ultraviolet absorbents, use can be made of non-reactive ultraviolet absorbents such as salicylate-series, benzophenone-series, benzotriazole-series, triazine-series, substituted acrylonitrile-series, and hindered amine-series ultraviolet absorbents; copolymers or graft polymers of thermoplastic resins (e.g., acrylic resins) obtained by introducing an addition-polymerizable double bond (e.g., a vinyl group, an acryloyl group, a methacryloyl group), or an alcoholic hydroxyl group, an amino group, a carboxyl group, an epoxy group, or an isocyanate group, to the non-reactive ultraviolet absorbents, subsequently copolymerizing or grafting. In addition, disclosed is a method of obtaining ultraviolet-shielding resins by the steps of dissolving ultraviolet absorbents in a monomer or oligomer of the resin to be used, and then polymerizing the monomer or oligomer (JP-A-2006-21333). In this case, the ultraviolet absorbents may be non-reactive.

Of these ultraviolet absorbents, preferred are benzophenone-series, benzotriazole-series, and triazine-series ultraviolet absorbents. It is preferred that these ultraviolet absorbents are used in combination so as to cover an effective ultraviolet absorption wavelength region according to characteristic properties of the dye that is used for image formation. Besides, in the case of non-reactive ultraviolet absorbents, it is preferred to use a mixture of two or more kinds of ultraviolet absorbents each having a different structure from each other so as to prevent the ultraviolet absorbents from precipitation.

Examples of commercially available ultraviolet absorbents include TINUVIN-P (trade name, manufactured by Ciba-Geigy), JF-77 (trade name, manufactured by JOHOKU CHEMICAL CO., LTD.), SEESORB 701 (trade name, manufactured by SHIRAISHI CALCIUM KAISHA, LTD.), SUMISORB 200 (trade name, manufactured by Sumitomo Chemical Co., Ltd.), VIOSORB 520 (trade name, manufactured by KYODO CHEMICAL CO., LTD.), and ADKSTAB LA-32 (trade name, manufactured by ADEKA).

<Surfactant>

Further in the heat-sensitive transfer image-receiving sheet used in the present invention, a surfactant may be contained in any of such layers as described above. Of these layers, it is preferable to contain the surfactant in the receptor layer and the interlayer.

An addition amount of the surfactant is preferably from 0.01% by mass to 5% by mass, more preferably from 0.01% by mass to 1% by mass, and especially preferably from 0.02% by mass to 0.2% by mass, based on the total solid content.

With respect to the surfactant, various kinds of surfactants such as anionic, nonionic and cationic surfactants are known. As the surfactant that can be used in the present invention, any known surfactants may be used. For example, it is possible to use surfactants as reviewed in "Kinosei kaimenkasseizai (Functional Surfactants)", editorial supervision of Mitsuo Tsunoda, edition on August in 2000, Chapter 6. Of these surfactants, fluorine-containing anionic surfactants are preferred.

<Matting Agent>

To the heat-sensitive transfer image-receiving sheet used in the present invention, a matting agent may be added in order to prevent blocking, or to give a release property or a sliding property. The matting agent may be added on the same side as the coating side of the receptor layer, or on the side opposite to the coating side of the receptor layer, or on both sides.

In the present invention, examples of the matting agent generally include fine particles of water-insoluble organic compounds and fine particles of water-insoluble inorganic compounds. In the present invention, the organic compound-containing fine particles are used from the viewpoints of dispersion properties. In so far as the organic compound is incorporated in the particles, there may be organic compound particles consisting of the organic compound alone, or alternatively organic/inorganic composite particles containing not only the organic compound but also an inorganic compound. As the matting agent, there can be used organic matting agents described in, for example, U.S. Pat. No. 1,939,213, No. 2,701,245, No. 2,322,037, No. 3,262,782, No. 3,539,344, and No. 3,767,448.

<Antiseptic>

To the heat-sensitive transfer image-receiving sheet used in the present invention, antiseptics may be added. The antiseptics that may be used in the image-receiving sheet in the invention are not particularly limited. For example, use can be made of materials described in *Bofubokabi* (*Preservation and Antifungi*) *HAND BOOK*, Gihodo shuppan (1986), *Bokin Bokabi no Kagaku* (*Chemistry of Anti-bacteria and Anti-fungi*) authored by Hiroshi Horiguchi, Sankyo Shuppan (1986), *Bokin Bokabizai Jiten* (*Encyclopedia of Antibacterial and Antifungal Agent*) edited by The Society for Antibacterial and Antifungal Agent, Japan (1986). Examples thereof include imidazole derivatives, sodium dehydroacetate, 4-isothiazoline-3-on derivatives, benzoisothiazoline-3-on, benzotriazole derivatives, amidineguanidine derivatives, quaternary ammonium salts, pyrrolidine, quinoline, guanidine derivatives, diazine, triazole derivatives, oxazole, oxazine derivatives, and 2-mercaptopyridine-N-oxide or its salt. Of these antiseptics, 4-isothiazoline-3-on derivatives and benzoisothiazoline-3-on are preferred.

<Humectant>

A humectant may be used to adjust variation of the water content owing to drying after the coating step by which a heat-sensitive transfer image-receiving sheet that is used in the present invention is manufactured, and/or to adjust variation of the water content, or alternatively to stabilize the water content in the period of time ranging from the production of the heat-sensitive transfer image-receiving sheet to the printing.

As the humectant, known moisturizing agents may be used. They may be selected from materials described in the sections of the aforementioned water-soluble polymers and the surfactants. More specifically, glycols (e.g., polyethylene glycol, etc.), starch, polysaccharide (e.g., carrageenase, dextrin etc.), sugar alcohol (e.g., sorbitol, mannitol, etc.), glycerol, and urea are exemplified.

<Support>

As the support that is used for the heat-sensitive transfer image-receiving sheet used in the present invention, there may be used previously known supports with a preferable example being a water-proof support. The usage of the water-proof support enables to prevent the support from absorbing moisture thereto, so that a change in properties of the receptor layer with the lapse of time can be prevented. As the water-proof support, there may be, for example, a coat paper, a laminate paper and a synthetic paper with a preferable example being a laminate paper.

(Curl Adjusting Layer)

In the heat-sensitive transfer image-receiving sheet that is used in the present invention, if necessary, a curl adjusting layer is preferably formed. For the curl adjusting layer, for example, a polyethylene laminate and a polypropylene laminate may be used. Specifically, the curl adjusting layer may be formed in the same manner as described in, for example, JP-A-61-110135 and JP-A-6-202295.

<Writing Layer and Charge Controlling Layer>

In the heat-sensitive transfer image-receiving sheet that is used in the present invention, if necessary, a writing layer or a charge controlling layer may be disposed. For the writing layer and the charge control layer, an inorganic oxide colloid, an ionic polymer, or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge control layer may be formed in a manner similar to those described in the specification of Japanese Patent No. 3,585,585.

3) Heat-Sensitive Transfer Sheet (Ink Sheet)

The ink sheet is used to transfer a colorant (dye) from the ink sheet to a heat-sensitive transfer image-receiving sheet in the following manner: when a thermally transferred image is formed, the ink sheet is put onto the heat-sensitive transfer image-receiving sheet and then the sheets are heated from the ink sheet side thereof by means of a thermal printer head or the like. The ink sheet used in the invention has a base film, a dye layer (heat-transferable layer) formed over one surface of the base film and containing a heat-transferable dye, and a heat-resistant lubricating layer formed over the other surface of the base film and containing an inorganic particle. An easily-adhesive layer (primer layer) may be formed between the base film and the dye layer or between the base film and the heat-resistant lubricating layer.

In the invention, the inorganic particles contained in the heat-resistant lubricating layer need have the following requirements (I) to (IV). The disappearance and non-uniformity of the image that is supposed to be caused by a shift of the contact position of the thermal head can be improved by the ink sheet having the following requirements. This effect is unexpectedly achieved even in the case where the aforementioned contact distance between the thermal head and the heat resistant lubricating layer does not substantially vary. In addition, by selecting the composition of the aforementioned heat-sensitive transfer image-receiving sheet and also by combining the selected composition and the ink sheet having the following requirements, it is possible to change the aforementioned contact distance between the thermal head and the heat resistant lubricating layer. Thereby the contact distance can be controlled so as to become within a preferable range.

Requirement (I): the Mohs' hardness thereof ranges from 3 to 6.

Requirement (II): the mean particle size thereof ranges from 0.3 to 5 μm.

Requirement (III): the ratio of the maximum width of each of the particles to the sphere equivalent diameter thereof is from 1.5 to 50.

Requirement (IV): the content ranges from 0.01% by mass to 5% by mass with respect to a total amount of the coated solid content by mass of the heat resistant lubricating layer.

The requirements (I) to (IV) will be successively described hereinafter.

Requirement (I)

Mohs' hardness is a hardness originating from German mineralogist Friedrich Mohs' idea, and is a hardness digitized on the basis of the situation of scratches or injures of a substance when the substance is scratched by a standard substance. Substances listed up from a soft substance toward harder substances are successively specified as standard substances of indexes 1 to 10. Specifically, talc is specified as the standard substance 1; gypsum, 2; calcite, 3; fluorite, 4; apatite, 5; orthoclase, 6; quartz, 7; topaz, 8; corundum, 9; and diamond, 10. For example, in a case where a sample is scratched with fluorite, which is the standard substance 4, so that the sample is not injured but the sample is scratched with apatite, which is the standard substance 5, so that the sample is injured, this sample is harder than the index 4 and softer than the index 5. This is represented as a Mohs' hardness of "4 to 5", or "4.5". In a case where a sample is scratched with fluorite, which is the standard substance 4, so that not only the sample but also the fluorite are injured, the sample has the same hardness as the standard substance 4. This is represented as a Mohs' hardness of "4". Any numerical value of Mohs' hardness is a relative value but is not any absolute value.

If the Mohs' hardness is excessively small in the present invention, the heat-sensitive transfer sheet cannot be restrained from being deformed in high-speed printing. When Mohs' hardness is excessively large, the heat-sensitive transfer sheet injures a thermal printer head. In the invention, the Mohs' hardness is preferably from 3 to 6, more preferably from 3.5 to 5.5.

The inorganic particles having a Mohs' hardness of 3 to 6 may be known inorganic particles. Examples thereof include calcium carbonate (Mohs' hardness: 3), dolomite ($MgCa(CO_3)_2$) (Mohs' hardness; 3.5-4), magnesium oxide (Mohs' hardness: 4), and magnesium carbonate (Mohs' hardness: 3.5-4.5). Of these examples, preferable are magnesium oxide and magnesium carbonate, and more preferable is magnesium oxide.

Requirement (II)

In the invention, the mean particle size of the particles is a value obtained by the laser diffractive scattering method. The spatial distribution of the diffractive scattered light intensities obtained by radiating light to the particles is varied in accordance with the sizes of the particles. Thus, when the spatial distribution of the diffractive scattered light intensities is measured and analyzed, the distribution of the particle sizes can be obtained. Such a technique has been established as the laser diffractive scattering method. A device used for the measurement may be a commercially available product, such as SALD series manufactured by Shimadzu Corp. or LA series manufactured by Horiba Ltd. (tradename).

The mean particle size is from 0.3 to 5 μm, preferably from 0.3 to 4.5 μm, more preferably from 0.4 to 4 μm.

Requirement (III)

The ratio of the maximum width of each of the inorganic particles to the sphere equivalent diameter thereof can be obtained from an observation of the particles with a scanning electron microscope, which is abbreviated to an "SEM". Specific steps therefore are as follows:

1. The inorganic particles are each observed with the SEM while the angle for the observation is varied. The shape, the length, and the thickness thereof are measured.

2. The particle volume is calculated out from the measured shape and size, and then the sphere equivalent diameter is obtained. The sphere equivalent diameter is the diameter of a sphere having a volume equal to the calculated-out particle volume. From the measured length and thickness, the maximum width of the particle is obtained. The maximum width of the particle is the maximum value out of lengths between any two points on the particle surface. When the inorganic particle is columnar, the maximum width corresponds to the height of the column. When the inorganic particle is a needle form, the maximum width corresponds to the length of the needle. When the inorganic particle is tabular, the maximum width corresponds to the largest width of the main plane(s).

3. The value of the ratio can be obtained by dividing the maximum width obtained about each of the particles by the sphere equivalent diameter. When the particulate form is spherical, the maximum width and the sphere equivalent diameter are equal to each other so that the ratio turns one. When the particulate form is cubic, the value of the ratio is about 1.4. As the particulate form is shifted more largely from a sphere, the value of the ratio becomes larger.

When particles contain therein pores, the volume of the particles cannot be precisely calculated. In this case, however, the ratio is obtained by making calculation on the supposition that the particles have no pores.

In connection with the ratio of the maximum width of each of the inorganic particles contained in the heat-resistant lubricating layer to the sphere equivalent diameter thereof, the ratio of the maximum width of any one selected from the inorganic particles contained in the heat-resistant lubricating layer to the sphere equivalent diameter thereof is varied in accordance with the selected particle. However, the ratio defined in the invention needs to range from 1.5 to 50 for 50 mass % or more of all the inorganic particles having a Mohs' hardness of 3 to 6, contained in the heat-resistant lubricating layer. This ratio ranges from 0.5 to 50 preferably for 80 mass % or more of all the inorganic particles having a Mohs' hardness of 3 to 6, contained in the heat-resistant lubricating layer, more preferably for 90 mass % or more thereof.

This ratio is from 1.5 to 50, preferably from 1.8 to 45, more preferably from 2 to 40.

Examples of the form of the inorganic particles wherein the ratio of the maximum width to the sphere equivalent diameter is from 1.5 to 50 in the invention include an indeterminate form; a columnar form; a needle form, which may be a spindle form; and a tabular form. However, the form is not limited to these forms. The particulate form is preferably a needle form or tabular form, more preferably a tabular form. In a preferred embodiment, needle form inorganic particles and tabular inorganic particles may be used together.

In order to produce the advantageous effects of the invention, the ratio of the mass of the contained inorganic particles to the total coating mass of the heat-resistant lubricating layer needs to range from 0.01 to 5 mass %. The ratio of the mass of the contained inorganic particles thereto is preferably from 0.03 to 4 mass %, more preferably from 0.05 to 2 mass %.

In the invention, the inorganic particles may be ones produced by a known method. When the inorganic particles are made of, for example, magnesium oxide, there are known: a method of firing a carbonate, a nitrate, a hydroxide and other salts of magnesium so as to be thermally decomposed; a method of subjecting magnesium to gas-phase oxidation; and other methods. In the firing, sintering or crystal growth is caused at the same time when the thermal decomposition is caused; thus, magnesium oxide in various forms can be produced in accordance with various conditions for the firing. In general, magnesium oxide resulting from firing at low temperature is called light burnt (calcined) magnesia, and magnesium oxide resulting from firing at high temperature is called heavy burnt magnesia (or dead burnt magnesia). An ingot obtained by melting magnesium oxide in a melting furnace such as an electric arc furnace and then solidifying the resultant is called electromelted magnesia. By pulverizing and/or classifying the resultant magnesium oxide particles, magnesium oxide particles having desired sizes can be obtained.

Inorganic particles contained as an impurity in a natural mineral may be used. JP-A-8-90945 states that dolomite ($MgCa(CO_3)_2$, magnesite (made mainly of magnesium carbonate), silica and others that are contained as impurities in talc, which is a soft natural mineral, are incorporated together with talc. JP-A-8-90945 discloses that the Mohs' hardnesses of the impurities may fall in the Mohs' hardness range defined in the invention and silica (Mohs' hardness 7) that is out of the range defined in the invention is effective. However, it is contrastive that silica is not only effective but also deteriorates in the present invention. Further, JP-A-8-90945 does not clarify the mean particle sizes thereof and the particulate forms thereof. In general, talc particles obtained by selecting an appropriate mineral from natural minerals, pulverizing the selected mineral, and classifying the pulverized particles into a desired purity and desired sizes are used as a starting material. However, impurities in the talc are not easily set to desired sizes and a desired form, and dispersion in the size and the form between individual lots is not easily restrained. Moreover, in JP-A-8-90945, a content of hard impurities in inorganic filler is defined by X-ray diffraction intensity ratio. However, it can not be recognized that X-ray diffraction intensity corresponds to the content because the X-ray diffraction intensity ratio depends on crystallinity of materials to be measured, that is, the diffraction intensity is strong when a crystal lattice is arranged in good order (high crystallinity) and the diffraction intensity is weak when a crystal lattice is arranged in disorder (low crystallinity). From these matters, the used inorganic particles are more preferably independently-produced particles than inorganic particles incorporated as impurities into the heat-resistant lubricating layer. In the case of magnesium oxide, magnesium oxide produced by firing is even more preferred from the viewpoint of productivity.

In the invention, it is particularly preferred that the amount of an impurity capable of forming inorganic particles having a Mohs' hardness of 3 or more, out of impurities contained in the inorganic particles, is small. In the case of magnesium oxide, the purity thereof is preferably 95 mass % or more, more preferably 98 mass % or more, most preferably 99 mass % or more. The total amount of calcium, silicon, iron, aluminum, chromium, cobalt, nickel, and copper as the impurities is preferably 2 mass % or less, even more preferably 1 mass % or less.

Besides the inorganic particles specified above, other additives may be used in the heat-resistant lubricating layer, examples of the additive including a lubricant, a plasticizer, a stabilizer, a bulking agent, and a filler. In the following description, any inorganic compound having a Mohs' hardness less than 3 or more than 6 is not included in the inorganic compound specified above, and the above-specified mean particle size, particle form and the ratio by mass are not applied to the inorganic compound. When one or more of the inorganic compounds described below have a Mohs' hardness ranging from 3 to 6, the inorganic compound(s) may be used together so as to match the description of the above-mentioned inorganic particles.

Examples of the lubricant include fluorides such as calcium fluoride, barium fluoride, and graphite fluoride; sulfides such as molybdenum disulfide, tungsten disulfide, and iron sulfide; oxides such as silica, colloidal silica, lead oxide, alumina, and molybdenum oxide; solid lubricants each made of an inorganic compound such as graphite, mica, boron nitride, or a clay (such as talc, kaolin, or acid white clay); organic resins such as fluorine-contained resin and silicone resin; silicone oils; phosphate monoesters (a compound wherein one out of three —OH groups connected with a phosphorous atom in a single molecule of phosphoric acid is esterified) and phosphate diesters (a compound wherein two out of the —OH groups are esterified) and alkali metal salts thereof; phosphate triesters (a compound wherein all of the —OH groups are esterified); metal soaps such as polyvalent metal salts of an alkylcarboxylic acid (such as zinc stearate and lithium stearate), and polyvalent metal salts of a phosphate ester (such as zinc stearyl phosphate, and calcium polyoxyethylene tridecyl ether phosphate); various waxes such as polyethylene wax, and paraffin wax; and surfactants such as anionic surfactants, cationic surfactants, amphoteric surfactants, nonionic surfactants, and fluorine-contained surfactants. When a material originating from a natural mineral is used as a solid lubricant, an impurity having a Mohs' hardness 3 or more unfavorably damages the advantageous effects of the invention; thus, it is preferable that the amount of the impurity is as small as possible.

Of these additives, which may be used together, preferable are talc, kaolin, phosphate esters having at least one —OH group, alkali metal salts thereof, polyvalent metal salts of an alkylcarboxylic acid, and polyvalent metal salts of a phosphate ester.

Some ester surfactants have acid groups. As result, when a large calorie is given thereto from a thermal head, the esters may decompose and further the pH of the backside layer may be lowered to corrode and abrade the thermal head largely. Examples of a method to be adopted against this problem include a method of using a neutralized ester surfactant, and a method of using a neutralizing agent such as magnesium hydroxide.

Other examples of the additives include higher aliphatic alcohols, organopolysiloxanes, and organic carboxylic acids.

The heat-resistant lubricating layer needs to contain a resin. The resin may be a known resin. Examples thereof include cellulose resins such as ethylcellulose, hydroxycellulose, hydroxypropylcellulose, methylcellulose, cellulose acetate, cellulose acetate butyrate, cellulose acetate propionate, and nitrocellulose; vinyl resins such as polyvinyl alcohol resin, polyvinyl acetate resin, polyvinyl butyral, polyvinyl acetal, polyvinyl acetoacetal resin, vinyl chloride-vinyl acetal copolymer and polyvinyl pyrrolidone; (meth)acrylic resins such as methyl polymethacrylate, ethyl polyacrylate, polyacrylamide, and acrylonitrile-styrene copolymer; other resins such as polyamide resin, polyimide resin, polyamide-imide resin, polyvinyl toluene resin, coumarone indene resin, polyester resin, polyurethane resin, polyether resin, polybutadiene resin, polycarbonate resin, chlorinated polyolefin resin, fluorine-contained resin, epoxy resin, phenol resin, silicone resin, silicone-modified or fluorine-modified urethane, and other natural or synthetic resins. These may be used alone or in a mixture form.

The resin may be crosslinked by radiating ultraviolet rays or an electron beam thereto in order to make the heat resistance high. A crosslinking agent may be used to crosslink the resin by aid of heating. At this time, a catalyst may be added thereto. Examples of the crosslinking agent include isocyanate based agents (such as polyisocyanate, and a cyclic trimer of polyisocyanate), and metal-containing agents (such as titanium tetrabutyrate, zirconium tetrabutyrate, and aluminum triisopropionate). Examples of the resin with which these crosslinking agents are each caused to react include polyvinyl acetal, polyvinyl butyral, polyester polyol, alkyd polyol, and silicone compounds containing, in side chains thereof, amino groups.

The heat-resistant lubricating layer is formed by adding the essential components and optional additives to the binder, examples of which have been described above, dissolving or dispersing the resultant into a solvent to prepare a coating solution, and then painting the coating solution by a known method such as gravure coating, roll coating, blade coating or wire bar coating. The film thickness of the heat-resistant lubricating layer is preferably from 0.1 to 3 μm, more preferably from 0.3 to 1.5 μm.

(Base Film)

As the base film, any one of known materials can be used, so far as such the material has both a heat resistance and a mechanical strength necessary to the requirements for the support. Specific examples of preferable base films include thin papers such as a glassine paper, a condenser paper, and a paraffin paper; polyesters having high resistance to heat such as polyethyleneterephthalate, polyethylenenaphthalate, polybuyleneterephthalate, polyphenylene sulfide, polyetherketone, and polyethersulfone; stretched or unstretched films of plastics such as polypropylene, polycarbonate, cellulose acetate, polyethylene derivatives, poly(vinyl chloride), poly (vinylidene chloride), polystyrene, polyamide, polyimide, polymethylpentene, and ionomers; and laminates of these materials. Of these materials, polyester films are especially preferred. Stretched polyester films are most preferred. A thickness of the base film can be properly determined in accordance with the material of the base film so that the mechanical strength and the heat resistance become optimum. Specifically, it is preferred to use a support having a thickness of about 1 μm to about 30 μm, more preferably from about 1 μm to 20 μm, and further preferably from about 3 μm to about 10 μm.

The dye layer containing a heat-transferable dye (hereinafter also referred to as the heat-sensitive transfer layer or the heat transfer layer) can be formed by painting a dye ink.

(Dye Layer)

In the dye layer in the invention, preferably, dye (sub)layers in individual colors of yellow, magenta and cyan, and an optional dye (sub)layer in black are repeatedly painted onto a single support in area order in such a manner that the colors are divided from each other. An example of the dye layer is an embodiment wherein dye (sub)layers in individual colors of yellow, magenta and cyan are painted onto a single support along the long axial direction thereof in area order, correspondingly to the area of the recording surface of the above-mentioned heat-sensitive transfer image-receiving sheet, in such a manner that the colors are divided from each other. Another example thereof is an embodiment wherein not only the three (sub)layers but also a dye (sub)layer in black and/or a transferable protective layer are painted in such a manner that these (sub)layers are divided from each other. This embodiment is preferred.

In the case of adopting such an embodiment, it is preferred to give marks to the heat-sensitive transfer sheet in order to inform the printer about starting point of the individual colors. Such painting repeated in area order makes it possible that a single heat-sensitive transfer sheet is used to form an image on the basis of transfer of dyes and further laminate a protective layer on the image.

In the invention, however, the manner in which the dye layer is formed is not limited to the above-mentioned manners. A sublimation heat-transferable ink layer and a heat-melt transferable ink layer may be together formed. A dye in a color other than yellow, magenta, cyan and black is formed, or other modifications may be made. The form of the heat-sensitive transfer sheet including the dye layer may be a longitudinal form, or a one-piece form.

The dye layer may have a mono-layered structure or a multi-layered structure. In the case of the multi-layered structure, the individual layers constituting the dye layer may be the same or different in composition.

(Dye Ink)

The dye layer contains at least a sublimation type dye and a binder resin. It is a preferable embodiment of the present invention that the ink may contains organic or inorganic finely divided powder, waxes, silicone resins, and fluorine-containing organic compounds, in accordance with necessity.

Each dye in the dye layer is preferably contained in an amount of 10 to 90 mass % of the dye layer, preferably in that of 20 to 80 mass % thereof.

The coating of the dye layer (i.e., the painting of a coating solution for the dye layer) is performed by an ordinary method such as roll coating, bar coating, gravure coating, or gravure reverse coating. The coating amount of the dye layer is preferably from 0.1 to 2.0 $g/m^2$, more preferably from 0.2 to 1.2 $g/m^2$ (the amount is a numerical value converted to the solid content in the layer; any coating amount in the following description is a numerical value converted to the solid content unless otherwise specified). The film thickness of the dye layer is preferably from 0.1 to 2.0 μm, more preferably from 0.2 to 1.2 μm.

<The Dyes>

The dyes contained in the dye layer in the present invention must be the dyes are able to diffuse by heat and able to be incorporated in a heat-sensitive transfer sheet, and able to transfer by heat from the heat-sensitive transfer sheet to an image-receiving sheet. As the dyes used for the heat-sensitive transfer sheet, ordinarily used dyes or known dyes can be effectively used.

Preferable examples of the dyes that is used in the present invention include diarylmethane-series dyes, triarylmethane-series dyes, thiazole-series dyes, methine-series dyes such as merocyanine; azomethine-series dyes typically exemplified by indoaniline, acetophenoneazomethine, pyrazoloazomethine, imidazole azomethine, imidazo azomethine, and pyridone azomethine; xanthene-series dyes; oxazine-series dyes; cyanomethylene-series dyes typically exemplified by dicyanostyrene, and tricyanostyrene; thiazine-series dyes; azine-series dyes; acridine-series dyes; benzene azo-series dyes; azo-series dyes such as pyridone azo, thiophene azo, isothiazole azo, pyrrol azo, pyralazo, imidazole azo, thiadiazole azo, triazole azo, and disazo; spiropyran-series dyes; indolinospiropyran-series dyes; fluoran-series dyes; rhodaminelactam-series dyes; naphthoquinone-series dyes; anthraquinone-series dyes; and quinophthalon-series dyes.

Specific examples of the yellow dyes include Disperse Yellow 231, Disperse Yellow 201 and Solvent Yellow 93. Specific examples of the magenta dyes include Disperse Violet 26, Disperse Red 60, and Solvent Red 19. Specific examples of the cyan dyes include Solvent Blue 63, Solvent Blue 36, Disperse Blue 354 and Disperse Blue 35. As a matter of course, it is also possible to use suitable dyes other than these dyes as exemplified above.

Further, dyes each having a different hue from each other as described above may be arbitrarily combined together. For instance, a black hue can be obtained from a combination of dyes.

In the present invention, dyes represented by any one of formulae (Y1) to (Y9), formulae (M1) to (M8), and formulae (C1) to (C4) set forth below are preferably used.

These dyes are explained in detail below.

Formula (Y1)

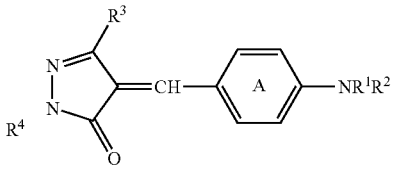

In the formula (Y1), the ring A represents a substituted or unsubstituted benzene ring; $R^1$ and $R^2$ each independently represent a hydrogen atom, a substituted or unsubstituted alkyl group, a substituted or unsubstituted alkenyl group or a substituted or unsubstituted aryl group; $R^3$ represents a hydrogen atom, a substituted or unsubstituted alkyl group, a substituted or unsubstituted amino group, a substituted or unsubstituted alkoxy group, a substituted or unsubstituted aryloxy group, a substituted or unsubstituted alkoxycarbonyl group, a substituted or unsubstituted aryloxycarbonyl group, a substituted or unsubstituted aryl group, or a substituted or unsubstituted carbamoyl group; and $R^4$ represents a substituted or unsubstituted alkyl group, or a substituted or unsubstituted aryl group.

Examples of the substituent by which each of the ring A and the groups $R^1$, $R^2$, $R^3$ and $R^4$ may be substituted include halogen atoms, unsaturated aliphatic groups, aryl groups, heterocyclic groups, aliphatic oxy groups (typically, alkoxy groups), acyloxy groups, carbamoyloxy groups, aliphatic oxycarbonyloxy groups (typically, alkoxycarbonyloxy groups), aryloxycarbonyl groups, amino groups, acylamino groups, aminocarbonylamino groups, aliphatic oxycarbonylamino groups (typically, alkoxycarbonylamino groups), sulfamoylamino groups, aliphatic (typically, alkyl) or arylsulfonylamino groups, aliphatic thio groups (typically, alkylthio groups), sulfamoyl groups, aliphatic (typically, alkyl) or arylsulfinyl groups, aliphatic (typically, alkyl) or arylsulfonyl groups, acyl groups, aryloxycarbonyl groups, aliphatic oxycarbonyl groups(typically, alkoxycarbonyl groups), carbamoyl groups, aryl or heterocyclic azo groups, imide groups, a hydroxy group, a cyano group, a nitro group, a sulfo group, and a carboxyl group.

These groups may each further have a substituent. Examples of the substituent include the above-mentioned substituents.

Examples of a preferred combination of the ring A and groups $R^1$ to $R^4$ in the dye represented by the formula (Y1) include combinations wherein the ring A is a substituted or unsubstituted benzene ring, $R^1$ is a substituted or unsubstituted alkyl group having 1 to 8 carbon atoms, an allyl group, or a substituted or unsubstituted aryl group having 6 to 10 carbon atoms, $R^2$ is a substituted or unsubstituted alkyl group having 1 to 8 carbon atoms, an allyl group, or a substituted or unsubstituted aryl group having 6 to 10 carbon atoms, $R^3$ is a substituted or unsubstituted amino group, or a substituted or unsubstituted alkoxy group, and $R^4$ is a substituted or unsubstituted alkyl group having 1 to 8 carbon atoms, or a substituted or unsubstituted aryl group having 6 to 10 carbon atoms.

In more preferred combinations thereof, the ring A is a substituted or unsubstituted benzene ring, $R^1$ is a substituted or unsubstituted alkyl group having 1 to 6 carbon atoms, an allyl group, or a substituted or unsubstituted phenyl group, $R^2$ is a substituted or unsubstituted alkyl group having 1 to 6 carbon atoms, an allyl group, or a substituted or unsubstituted phenyl group, $R^3$ is a substituted or unsubstituted amino group, or a substituted or unsubstituted alkoxy group, and $R^4$ is a substituted or unsubstituted alkyl group having 1 to 6 carbon atoms, or a substituted or unsubstituted phenyl group.

In the most preferred combinations thereof, the ring A is a benzene ring substituted by a methyl group or a chlorine atom, or an unsubstituted benzene ring, $R^1$ is a substituted or unsubstituted alkyl group having 1 to 4 carbon atoms, or an allyl group, $R^2$ is a substituted or unsubstituted alkyl group having 1 to 4 carbon atoms, or an allyl group, $R^3$ is a substituted or unsubstituted amino group, or a substituted or unsubstituted alkoxy group, and $R^4$ is a substituted or unsubstituted phenyl group.

Formula (Y2)

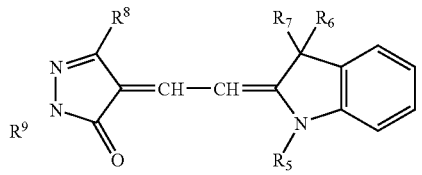

In the formula (Y2), $R^5$ represents a substituted or unsubstituted alkyl group, or a substituted or unsubstituted alkenyl group, $R^6$ and $R^7$ each independently represent a substituted or unsubstituted alkyl group, $R^8$ represents a substituted or unsubstituted alkyl group, a substituted or unsubstituted aryl group, a substituted or unsubstituted alkoxy group, or a substituted or unsubstituted amino group, and $R^9$ represents a substituted or unsubstituted alkyl group, or a substituted or unsubstituted aryl group.

Each of the groups represented by $R^5$, $R^6$, $R^7$, $R^8$ and $R^9$ may further have a substituent. Examples of a substituent by which each of the groups of $R^5$, $R^6$, $R^7$, $R^8$ and $R^9$ may be substituted include the same substituents as each of the ring A and the substituents $R^1$ to $R^4$ in the formula (Y1) may have.

Examples of a preferred combination of the groups $R^5$ to $R^9$ in the dye represented by the formula (Y2) include combinations wherein $R^5$ is a substituted or unsubstituted alkyl group having 1 to 8 carbon atoms, or an allyl group, $R^6$ is a substituted or unsubstituted alkyl group having 1 to 8 carbon atoms, $R^7$ is a substituted or unsubstituted alkyl group having 1 to 8 carbon atoms, $R^8$ is a substituted or unsubstituted alkyl group having 1 to 8 carbon atoms, a substituted or unsubstituted aryl group having 6 to 10 carbon atoms, a substituted or unsubstituted alkoxy group having 1 to 8 carbon atoms, or a substituted or unsubstituted amino group, and $R^9$ represents a substituted or unsubstituted alkyl group having 1 to 8 carbon atoms, or a substituted or unsubstituted aryl group having 6 to 10 carbon atoms.

In more preferred combinations thereof, $R^5$ is a substituted or unsubstituted alkyl group having 1 to 6 carbon atoms, or an allyl group, $R^6$ is a substituted or unsubstituted alkyl group having 1 to 6 carbon atoms, $R^7$ is a substituted or unsubstituted alkyl group having 1 to 6 carbon atoms, $R^8$ is a substituted or unsubstituted alkyl group having 1 to 6 carbon atoms, a substituted or unsubstituted phenyl group, a substituted or unsubstituted alkoxy group having 1 to 6 carbon atoms, or a substituted or unsubstituted amino group, and $R^9$ represents a substituted or unsubstituted alkyl group having 1 to 6 carbon atoms, or a substituted or unsubstituted phenyl group.

In the most preferred combinations thereof, $R^5$ is an unsubstituted alkyl group having 1 to 4 carbon atoms, $R^6$ is an unsubstituted alkyl group having 1 to 4 carbon atoms, $R^7$ is, an unsubstituted alkyl group having 1 to 4 carbon atoms, $R^8$ is a methoxy, ethoxy, or dimethylamino group, and $R^9$ is an unsubstituted phenyl group.

Formula (Y3)

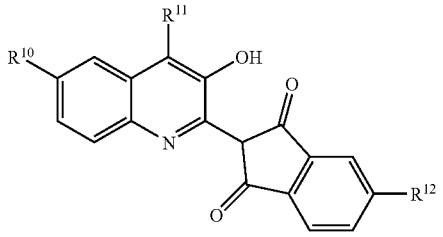

In the formula (Y3), $R^{10}$ represents a hydrogen atom, or a substituted or unsubstituted alkyl group, $R^{11}$ represents a hydrogen atom or a halogen atom, and $R^{12}$ represents a substituted or unsubstituted alkoxycarbonyl group, a substituted or unsubstituted aryloxycarbonyl group, or a substituted or unsubstituted carbamoyl group.

Each of the groups represented by $R^{10}$ and $R^{12}$ may further have a substituent. Examples of a substituent by which each of the groups of $R^{10}$ and $R^{12}$ may be substituted include the same substituents as each of the ring A and the substituents $R^1$ to $R^4$ in the formula (Y1) may have.

Examples of a preferred combination of the groups $R^{10}$ to $R^{12}$ in the dye represented by the formula (Y3) include combinations wherein $R^{10}$ is a hydrogen atom or a substituted or unsubstituted alkyl group having 1 to 8 carbon atoms, $R^{11}$ is a hydrogen atom, a chlorine atom, or a bromine atom, and $R^{12}$ is an unsubstituted alkoxycarbonyl group, an unsubstituted aryloxycarbonyl group, or a substituted or unsubstituted carbamoyl group.

In more preferred combinations thereof, $R^{10}$ is a hydrogen atom or a substituted or unsubstituted alkyl group having 1 to 6 carbon atoms, $R^{11}$ is a hydrogen atom or a bromine atom, and $R^{12}$ is an unsubstituted alkoxycarbonyl group having 2 to 10 carbon atoms, or a dialkylcarbamoyl group having 2 to 12 carbon atoms.

In the most preferred combinations thereof, $R^{10}$ is a hydrogen atom or an unsubstituted alkyl group having 2 to 4 carbon atoms, $R^{11}$ is a hydrogen atom, and $R^{12}$ is a dialkylcarbamoyl group having 2 to 10 carbon atoms.

Formula (Y4)

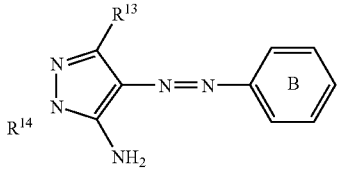

In the formula (Y4), the ring B represents a substituted or unsubstituted aryl group, or a substituted or unsubstituted aromatic heterocyclic group, $R^{13}$ represents a substituted or unsubstituted alkyl group, and $R^{14}$ represents a substituted or unsubstituted alkyl group, or a substituted or unsubstituted aryl group.

Each of the ring B and the groups represented by $R^{13}$ and $R^{14}$ may further have a substituent. Examples of a substituent by which each of the ring B and the groups of $R^{13}$ and $R^{14}$ may be substituted include the same substituents as each of the ring A and the substituents $R^1$ to $R^4$ in the formula (Y1) may have.

Examples of a preferred combination of the ring B and the groups $R^{13}$ and $R^{14}$ in the dye represented by the formula (Y4) include combinations wherein the ring B is a substituted or unsubstituted aryl group having 6 to 10 carbon atoms, a substituted or unsubstituted pyrazolyl group, or a substituted or unsubstituted thiadiazolyl group, $R^{13}$ is a substituted or unsubstituted alkyl group having 1 to 8 carbon atoms, and $R^{14}$ is a substituted or unsubstituted alkyl group having 1 to 8 carbon atoms, or a substituted or unsubstituted aryl group having 6 to 10 carbon atoms.

In more preferred combinations thereof, the ring B is a substituted or unsubstituted phenyl group, or a substituted or unsubstituted 1,3,4-thiadiazolyl group, $R^{13}$ is a substituted or unsubstituted alkyl group having 1 to 6 carbon atoms, and $R^{14}$ is a substituted or unsubstituted alkyl group having 1 to 6 carbon atoms, or a substituted or unsubstituted phenyl group.

In the most preferred combinations thereof, the ring B is a 4-nitrophenyl group, or a 1,3,4-thiadiazolyl group having a thioalkyl group having 1 to 6 carbon atoms as a substituent, $R^{13}$ is an unsubstituted alkyl group having 1 to 4 carbon atoms, and $R^{14}$ is an unsubstituted alkyl group having 1 to 4 carbon atoms, or a substituted or unsubstituted phenyl group.

Formula (Y5)

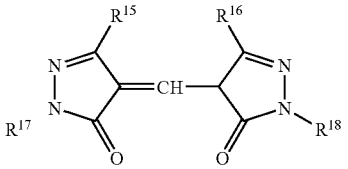

In the formula (Y5), $R^{15}$, $R^{16}$, $R^{17}$ and $R^{18}$ each independently represent a substituted or unsubstituted alkyl group or a substituted or unsubstituted aryl group.

Each of the groups represented by $R^{15}$, $R^{16}$, $R^{17}$ and $R^{18}$ may further have a substituent. Examples of a substituent by which each of the groups of $R^5$, $R^6$, $R^{17}$ and $R^{18}$ may be substituted include the same substituents as each of the ring A and the substituents $R^1$ to $R^4$ in the formula (Y1) may have.

Examples of a preferred combination of the substituents $R^{15}$ to $R^{18}$ in a dye represented by the formula (Y5) include combinations wherein $R^{15}$ is a substituted or unsubstituted alkyl group having 1 to 8 carbon atoms or a substituted or unsubstituted aryl group having 6 to 10 carbon atoms, $R^{16}$ is a substituted or unsubstituted alkyl group having 1 to 8 carbon atoms or a substituted or unsubstituted aryl group having 6 to 10 carbon atoms, $R^{17}$ is a substituted or unsubstituted alkyl group having 1 to 8 carbon atoms or a substituted or unsubstituted aryl group having 6 to 10 carbon atoms, and $R^{18}$ is a substituted or unsubstituted alkyl group having 1 to 8 carbon atoms or a substituted or unsubstituted aryl group having 6 to 10 carbon atoms.

In more preferred combinations of the substituents $R^{15}$ to $R^{18}$, $R^{15}$ is a substituted or unsubstituted alkyl group having 1 to 6 carbon atoms, $R^{16}$ is a substituted or unsubstituted alkyl group having 1 to 6 carbon atoms, $R^{17}$ is a substituted or unsubstituted phenyl group, and $R^{18}$ is a substituted or unsubstituted phenyl group.

In the most preferred combinations thereof, $R^{15}$ is a substituted or unsubstituted alkyl group having 1 to 4 carbon atoms, $R^{16}$ is a substituted or unsubstituted alkyl group having 1 to 4 carbon atoms, $R^{17}$ is an unsubstituted phenyl group, and $R^{18}$ is an unsubstituted phenyl group.

Formula (Y6)

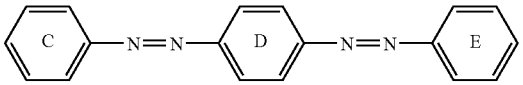

In the formula (Y6), the rings C, D and E each independently represent a substituted or unsubstituted benzene ring.

Each of the rings C, D and E may further have a substituent. Examples of a substituent by which each of the rings C, D and E may be substituted include the same substituents as each of the ring A and the substituents $R^1$ to $R^4$ in the formula (Y1) may have.

The ring C is preferably a benzene ring substituted by an alkyl group having 1 to 8 carbon atoms, a benzene ring substituted by an alkoxy group having 1 to 8 carbon atoms, a benzene ring substituted by a hydroxyl group, or an unsubstituted benzene ring, more preferably a benzene ring substituted by an alkyl group having 1 to 6 carbon atoms, a benzene ring substituted by an alkoxy group having 1 to 6 carbon atoms, or a benzene ring substituted by a hydroxyl group, most preferably a benzene ring substituted by an alkyl group having 1 to 4 carbon atoms, or a benzene ring substituted by an alkoxy group having 1 to 4 carbon atoms.

The ring D is preferably a benzene ring substituted by an alkyl group having 1 to 8 carbon atoms, or an unsubstituted benzene ring, more preferably a benzene ring substituted by an alkyl group having 1 to 6 carbon atoms, or an unsubstituted benzene ring, most preferably a benzene ring substituted by an alkyl group having 1 to 4 carbon atoms, or an unsubstituted benzene ring.

The ring E is preferably a benzene ring substituted by a hydroxyl group and an alkyl group having 1 to 8 carbon atoms, or a benzene ring substituted by a hydroxyl group and an alkoxy group having 1 to 8 carbon atoms, more preferably a benzene ring substituted by a hydroxyl group and an alkyl group having 1 to 6 carbon atoms, or a benzene ring substituted by a hydroxyl group and an alkoxy group having 1 to 6 carbon atoms, most preferably a benzene ring substituted by a hydroxyl group and an alkyl group having 1 to 4 carbon atoms, or a benzene ring substituted by a hydroxyl group and an alkoxy group having 1 to 4 carbon atoms.

Formula (Y7)

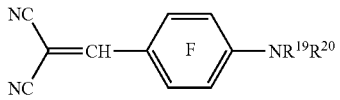

In the formula (Y7), the ring F represents a substituted or unsubstituted benzene ring; and $R^{19}$ and $R^{20}$ each independently represent a hydrogen atom, a substituted or unsubstituted alkyl group, a substituted or unsubstituted alkenyl group or a substituted or unsubstituted aryl group.

Each of the ring F and the groups represented by $R^{19}$ and $R^{20}$ may further have a substituent. Examples of a substituent by which each of the ring F and the groups of $R^{19}$ and $R^{20}$ may be substituted include the same substituents as each of the ring A and the substituents $R^1$ to $R^4$ in the formula (Y1) may have.

Examples of a preferred combination of the ring F and the substituents $R^{19}$ and $R^{20}$ in a dye represented by the formula (Y7) include combinations wherein the ring F is an unsubstituted benzene ring, $R^{19}$ is a substituted or unsubstituted alkyl group having 1 to 8 carbon atoms, an allyl group or a substituted or unsubstituted aryl group having 6 to 10 carbon atoms, and $R^{20}$ is a substituted or unsubstituted alkyl group having 1 to 8 carbon atoms, an allyl group or a substituted or unsubstituted aryl group having 6 to 10 carbon atoms.

In more preferred combinations of the ring F and the substituents $R^{19}$ and $R^{20}$, the ring F is a substituted or unsubstituted benzene ring, $R^{19}$ is a substituted or unsubstituted alkyl group having 1 to 6 carbon atoms, an allyl group or a substituted or unsubstituted phenyl group, and $R^{20}$ is a substituted or unsubstituted alkyl group having 1 to 6 carbon atoms, an allyl group or a substituted or unsubstituted phenyl group.

In the most preferred combinations thereof, the ring F is a benzene ring substituted by a methyl group, $R^{19}$ is an unsubstituted alkyl group having 1 to 4 carbon atoms, and $R^{20}$ is a substituted alkyl group having 1 to 4 carbon atoms.

Formula (Y8)

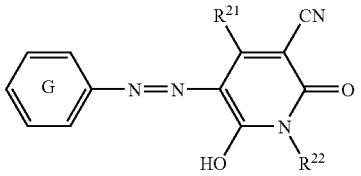

In the formula (Y8), the ring G represents a substituted or unsubstituted benzene ring; and $R^{21}$ and $R^{22}$ each independently represent a hydrogen atom or a substituted or unsubstituted alkyl group.

Each of the ring G and the groups represented by $R^{21}$ and $R^{22}$ may further have a substituent. Examples of a substituent by which each of the ring G and the groups of $R^{21}$ and $R^{22}$ may be substituted include the same substituents as each of the ring A and the substituents $R^1$ to $R^4$ in the formula (Y1) may have.

Examples of a preferred combination of the ring G and the substituents $R^{21}$ and $R^{22}$ include combinations wherein the ring G is a benzene ring having a substituent(s), $R^{21}$ is a substituted or unsubstituted alkyl group having 1 to 8 carbon atoms, and $R^{22}$ is a substituted or unsubstituted alkyl group having 1 to 8 carbon atoms.

In more preferred combinations thereof, the ring G is a benzene ring substituted by a substituted or unsubstituted alkoxycarbonyl group, $R^{21}$ is a substituted or unsubstituted alkyl group having 1 to 6 carbon atoms, and $R^{22}$ is a substituted or unsubstituted alkyl group having 1 to 6 carbon atoms.

In the most preferred combinations thereof, the ring G is a benzene ring substituted by a substituted or unsubstituted alkoxycarbonyl group, $R^{21}$ is a substituted or unsubstituted alkyl group having 1 to 4 carbon atoms, and $R^{22}$ is a substituted or unsubstituted alkyl group having 1 to 4 carbon atoms.

Formula (Y9)

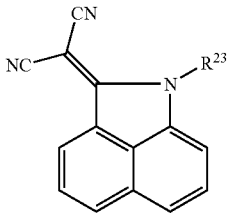

In the formula (Y9), $R^{23}$ represents a substituted or unsubstituted alkyl group or a substituted or unsubstituted alkenyl group.

The group represented by $R^{23}$ may further have a substituent. Examples of a substituent by which the group of $R^{23}$ may be substituted include the same substituents as each of the ring A and the substituents $R^1$ to $R^4$ in the formula (Y1) may have.

$R^{23}$ is preferably a substituted or unsubstituted alkyl group having 1 to 8 carbon atoms or an allyl group, more preferably a substituted or unsubstituted alkyl group having 1 to 6 carbon atoms or an allyl group, and most preferably a substituted or unsubstituted alkyl group having 1 to 4 carbon atoms or an allyl group.

Formula (M1)

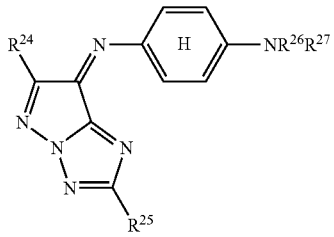

In the formula (M1), the ring H represents a substituted or unsubstituted benzene ring or a substituted or unsubstituted pyridine ring; and $R^{24}$, $R^{25}$, $R^{26}$ and $R^{27}$ each independently represent a substituted or unsubstituted alkyl group, a substituted or unsubstituted alkenyl group or a substituted or unsubstituted aryl group.

Each of the ring H and the groups represented by $R^{24}$, $R^{25}$, $R^{26}$ and $R^{27}$ may further have a substituent. Examples of a substituent by which each of the ring H and the groups of $R^{24}$, $R^{25}$, $R^{26}$ and $R^{27}$ may be substituted include the same substituents as each of the ring A and the substituents $R^1$ to $R^4$ in the formula (Y1) may have.

Examples of a preferred combination of the ring H and the substituents $R^{24}$ to $R^{27}$ in a dye represented by the formula (M1) include combinations wherein the ring H is an unsubstituted benzene ring, $R^{24}$ is a substituted or unsubstituted alkyl group having 1 to 8 carbon atoms or a substituted or unsubstituted aryl group having 6 to 10 carbon atoms, $R^{25}$ is a substituted or unsubstituted alkyl group having 1 to 8 carbon atoms or a substituted or unsubstituted aryl group having 6 to 10 carbon atoms, $R^{26}$ is a substituted or unsubstituted alkyl group having 1 to 8 carbon atoms or an allyl group, and $R^{27}$ is a substituted or unsubstituted alkyl group having 1 to 8 carbon atoms or an allyl group.

In more preferred combinations of the ring H and the substituents $R^{24}$ to $R^{27}$, the ring H is an unsubstituted benzene ring, $R^{24}$ is a substituted or unsubstituted phenyl group, $R^{25}$ is a substituted or unsubstituted alkyl group having 1 to 8 carbon atoms, $R^{26}$ is a substituted or unsubstituted alkyl group having 1 to 6 carbon atoms, and $R^{27}$ is a substituted or unsubstituted alkyl group having 1 to 6 carbon atoms.

In the most preferred combinations, the ring H is an unsubstituted benzene ring, $R^{24}$ is a 2-chlorophenyl group, $R^{25}$ is a substituted or unsubstituted alkyl group having 1 to 4 carbon atoms, $R^{26}$ is a substituted or unsubstituted alkyl group having 1 to 4 carbon atoms, and $R^{27}$ is a substituted or unsubstituted alkyl group having 1 to 4 carbon atoms.

Formula (M2)

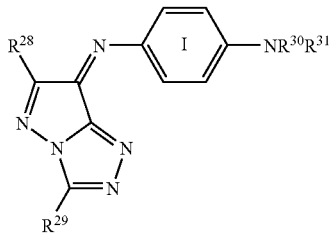

In the formula (M2), the ring I represents a substituted or unsubstituted benzene ring or a substituted or unsubstituted pyridine ring; and $R^{28}$, $R^{29}$, $R^{30}$ and $R^{31}$ each independently represent a substituted or unsubstituted alkyl group, a substituted or unsubstituted alkenyl group or a substituted or unsubstituted aryl group.

Each of the ring I and the groups represented by $R^{28}$, $R^{29}$, $R^{30}$ and $R^{31}$ may further have a substituent. Examples of a substituent by which each of the ring I and the groups of $R^{28}$, $R^{29}$, $R^{30}$ and $R^{31}$ may be substituted include the same substituents as each of the ring A and the substituents $R^1$ to $R^4$ in the formula (Y1) may have.

Examples of a preferred combination of the ring I and the substituents $R^{28}$ to $R^{31}$ in a dye represented by the formula (M2) include combinations wherein the ring I is a substituted or unsubstituted pyridine ring or an unsubstituted benzene ring, $R^{28}$ is a substituted or unsubstituted alkyl group having 1 to 8 carbon atoms or a substituted or unsubstituted aryl group having 6 to 10 carbon atoms, $R^{29}$ is a substituted or unsubstituted alkyl group having 1 to 8 carbon atoms or a substituted or unsubstituted aryl group having 6 to 10 carbon atoms, $R^{30}$ is a substituted or unsubstituted alkyl group having 1 to 8 carbon atoms or an allyl group, and $R^{31}$ is a substituted or unsubstituted alkyl group having 1 to 8 carbon atoms or an allyl group.

In more preferred combinations of the ring I and the substituents $R^{28}$ to $R^{31}$, the ring I is a substituted or unsubstituted pyridine ring or an unsubstituted benzene ring, $R^{28}$ is a substituted or unsubstituted alkyl group having 1 to 6 carbon atoms, $R^{29}$ is a substituted or unsubstituted alkyl group having 1 to 6 carbon atoms, $R^{30}$ is a substituted or unsubstituted alkyl group having 1 to 6 carbon atoms, and $R^{30}$ is a substituted or unsubstituted alkyl group having 1 to 6 carbon atoms.

In the most preferred combinations thereof, the ring I is a substituted or unsubstituted pyridine ring or an unsubstituted benzene ring, $R^{28}$ is a substituted or unsubstituted alkyl group having 1 to 4 carbon atoms, $R^{29}$ is a substituted or unsubstituted alkyl group having 1 to 4 carbon atoms, $R^{30}$ is a substituted or unsubstituted alkyl group having 1 to 4 carbon atoms.

Formula (M3)

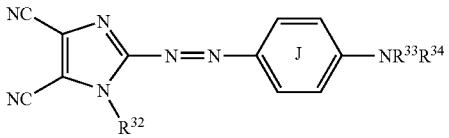

In the formula (M3), the ring J represents a substituted or unsubstituted benzene ring, and $R^{32}$, $R^{33}$ and $R^{34}$ each independently represent a substituted or unsubstituted alkyl group, a substituted or unsubstituted alkenyl group or a substituted or unsubstituted aryl group.

Each of the ring J and the groups represented by $R^{32}$, $R^{33}$ and $R^{34}$ may further have a substituent. Examples of a substituent by which each of the ring J and the groups of $R^{32}$, $R^{33}$ and $R^{34}$ may be substituted include the same substituents as each of the ring A and the substituents $R^1$ to $R^4$ in the formula (Y1) may have.

Examples of a preferred combination of the ring 3 and the substituents $R^{32}$ to $R^{34}$ in a dye represented by the formula (M3) include combinations wherein the ring J is a benzene ring substituted by an acylamino group having 2 to 8 carbon atoms, $R^{32}$ is a substituted or unsubstituted alkyl group having 1 to 8 carbon atoms or an acyl group, $R^{33}$ is a substituted or unsubstituted alkyl group having 1 to 8 carbon atoms or an allyl group, and $R^{34}$ is a substituted or unsubstituted alkyl group having 1 to 8 carbon atoms or an allyl group.

In more preferred combinations of the ring J and the substituents $R^{12}$ to $R^{34}$, the ring J is a benzene ring substituted by an acylamino group having 2 to 6 carbon atoms, $R^{32}$ is a substituted or unsubstituted alkyl group having 1 to 6 carbon atoms or an acyl group, $R^{33}$ is a substituted or unsubstituted alkyl group having 1 to 6 carbon atoms or an allyl group, and $R^{34}$ is a substituted or unsubstituted alkyl group having 1 to 6 carbon atoms or an allyl group.

In the most preferred combinations thereof, the ring J is a benzene ring substituted by an acylamino group having 2 to 4 carbon atoms, $R^{32}$ is a substituted or unsubstituted alkyl group having 1 to 4 carbon atoms or an acyl group, $R^{33}$ is a substituted or unsubstituted alkyl group having 1 to 4 carbon atoms or an allyl group, and $R^{34}$ is a substituted or unsubstituted alkyl group having 1 to 4 carbon atoms or an allyl group.

Formula (M4)

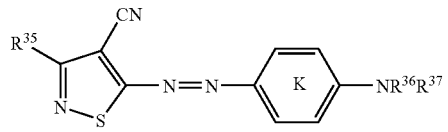

In the formula (M4), the ring K represents a substituted or unsubstituted benzene ring, and $R^{35}$, $R^6$ and $R^{37}$ each independently represent a substituted or unsubstituted alkyl group, a substituted or unsubstituted alkenyl group or a substituted or unsubstituted aryl group.

Each of the ring K and the groups represented by $R^{35}$, $R^{36}$ and $R^{37}$ may further have a substituent. Examples of a substituent by which each of the ring K and the groups of $R^{35}$, $R^{36}$ and $R^{37}$ may be substituted include the same substituents as each of the ring A and the substituents $R^1$ to $R^4$ in the formula (Y1) may have.

Examples of a preferred combination of the ring K and the substituents $R^{35}$ to $R^{37}$ in a dye represented by the formula (M4) include combinations wherein the ring K is a benzene ring substituted by an acylamino group having 2 to 8 carbon atoms, $R^{35}$ is a substituted or unsubstituted alkyl group having 1 to 8 carbon atoms, $R^{36}$ is a substituted or unsubstituted alkyl group having 1 to 8 carbon atoms or an allyl group, and $R^{37}$ is a substituted or unsubstituted alkyl group having 1 to 8 carbon atoms or an allyl group.

In more preferred combinations of the ring K and the substituents $R^{35}$ to $R^{37}$, the ring K is a benzene ring substituted by an acylamino group having 2 to 6 carbon atoms, $R^{35}$ is a substituted or unsubstituted alkyl group having 1 to 6 carbon atoms, $R^{36}$ is a substituted or unsubstituted alkyl group having 1 to 6 carbon atoms or an allyl group, and $R^{37}$ is a substituted or unsubstituted alkyl group having 1 to 6 carbon atoms or an allyl group.

In the most preferred combinations thereof, the ring K is a benzene ring substituted by an acylamino group having 2 to 4 carbon atoms, $R^{35}$ is a substituted or unsubstituted alkyl group having 1 to 4 carbon atoms, $R^{36}$ is a substituted or unsubstituted alkyl group having 1 to 4 carbon atoms or an allyl group, and $R^{37}$ is a substituted or unsubstituted alkyl group having 1 to 4 carbon atoms or an allyl group.

Formula (M5)

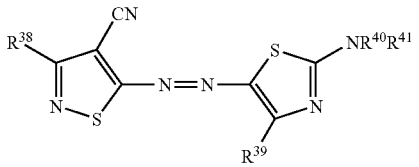

In the formula (M5), $R^{38}$ and $R^{39}$ each independently represent a substituted or unsubstituted alkyl group, a substituted or unsubstituted aryl group, or a substituted or unsubstituted heterocyclic group, and $R^{40}$ and $R^{41}$ each independently represent a substituted or unsubstituted alkyl group, a substituted or unsubstituted alkenyl group, or a substituted or unsubstituted aryl group.

Each of the groups represented by $R^{38}$ to $R^{41}$ may further have a substituent. Examples of a substituent by which $R^{38}$ to $R^{41}$ each may be substituted include the same substituents as each of the ring A and the substituents $R^1$ to $R^4$ in the formula (Y1) may have.

Examples of a preferred combination of the substituents $R^{38}$ to $R^{41}$ in a dye represented by the formula (M5) include combinations wherein $R^{38}$ is a substituted or unsubstituted alkyl group having 1 to 8 carbon atoms or a substituted or unsubstituted aryl group having 6 to 10 carbon atoms, $R^{39}$ is a substituted or unsubstituted alkyl group having 1 to 8 carbon atoms or a substituted or unsubstituted aryl group having 6 to 10 carbon atoms, $R^{40}$ is a substituted or unsubstituted alkyl group having 1 to 8 carbon atoms or a substituted or unsubstituted aryl group having 6 to 10 carbon atoms, and $R^{41}$ is a substituted or unsubstituted alkyl group having 1 to 8 carbon atoms or a substituted or unsubstituted aryl group having 6 to 10 carbon atoms.

In more preferred combinations of the substituents $R^{38}$ to $R^{41}$, $R^{38}$ is a substituted or unsubstituted alkyl group having 1 to 6 carbon atoms or a substituted or unsubstituted phenyl group, $R^{39}$ is a substituted or unsubstituted alkyl group having 1 to 6 carbon atoms or a substituted or unsubstituted phenyl group, $R^{40}$ is a substituted or unsubstituted alkyl group having 1 to 6 carbon atoms, and $R^{41}$ is a substituted or unsubstituted alkyl group having 1 to 6 carbon atoms.

In the most preferred combinations thereof, $R^{38}$ is a substituted or unsubstituted alkyl group having 1 to 4 carbon atoms or a substituted or unsubstituted phenyl group, $R^{39}$ is a substituted or unsubstituted alkyl group having 1 to 4 carbon atoms or a substituted or unsubstituted phenyl group, $R^{40}$ is a substituted or unsubstituted alkyl group having 1 to 4 carbon atoms, and $R^{41}$ is a substituted or unsubstituted alkyl group having 1 to 4 carbon atoms.

Formula (M6)

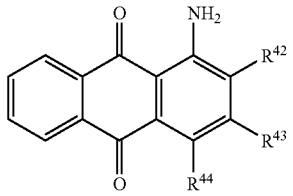

In the formula (M6), $R^{42}$ is a substituted or unsubstituted aryloxy group, $R^{43}$ is a hydrogen atom, or a substituted or unsubstituted aryloxy group, and $R^{44}$ is a hydroxyl group, or a substituted or unsubstituted amino group.

Each of the groups represented by $R^{42}$ and $R^{43}$ may further have a substituent. Examples of a substituent by which each of the groups of $R^{42}$ and $R^{43}$ may be substituted include the same substituents as each of the ring A and the substituents $R^1$ to $R^4$ in the formula (Y1) may have.

Examples of a preferred combination of the groups $R^{42}$ to $R^{44}$ in the dye represented by the formula (M6) include combinations wherein $R^{42}$ is a substituted or unsubstituted aryloxy group having 6 to 10 carbon atoms, $R^{43}$ is a hydrogen atom, or a substituted or unsubstituted aryloxy group having 6 to 10 carbon atoms, and $R^{44}$ is a hydroxyl group, or an unsubstituted amino group.

In more preferred combinations thereof, $R^{42}$ is a substituted or unsubstituted phenoxy group, $R^{43}$ is a hydrogen atom or a substituted or unsubstituted phenoxy group, and $R^{44}$ is a hydroxyl group, or an unsubstituted amino group.

In the most preferred combinations thereof, $R^{42}$ is a phenoxy group substituted by a substituted or unsubstituted amino group, or an unsubstituted phenoxy group, $R^{43}$ is a hydrogen atom, or a substituted or unsubstituted phenoxy group, and $R^{44}$ is a hydroxyl group, or an unsubstituted amino group.

Formula (M7)

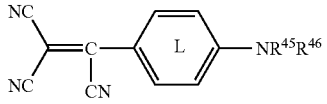

In the formula (M7), the ring L represents a substituted or unsubstituted benzene ring; and $R^{45}$ and $R^{46}$ each independently represent a hydrogen atom, a substituted or unsubstituted alkyl group, a substituted or unsubstituted alkenyl group or a substituted or unsubstituted aryl group.

Each of the ring L and the groups represented by $R^{45}$ and $R^{46}$ may further have a substituent. Examples of a substituent by which each of the ring L and the groups of $R^{45}$ and $R^{46}$ may be substituted include the same substituents as each of the ring A and the substituents $R^1$ to $R^4$ in the formula (Y1) may have.

Examples of a preferred combination of the ring L and the substituents $R^{45}$ and $R^{46}$ include combinations wherein the ring L is a substituted or unsubstituted benzene ring, $R^{45}$ is a substituted or unsubstituted alkyl group having 1 to 8 carbon atoms, an allyl group, or a substituted or unsubstituted aryl group having 6 to 10 carbon atoms, and $R^{46}$ is a substituted or unsubstituted alkyl group having 1 to 8 carbon atoms, an allyl group, or a substituted or unsubstituted aryl group having 6 to 10 carbon atoms.

In more preferred combinations of the ring L and the substituents $R^{45}$ and $R^{46}$, the ring L is a substituted or unsubstituted benzene ring, $R^{45}$ is a substituted or unsubstituted alkyl group having 1 to 6 carbon atoms, an allyl group, or a substituted or unsubstituted phenyl group, and $R^{46}$ is a substituted or unsubstituted alkyl group having 1 to 6 carbon atoms, an allyl group, or a substituted or unsubstituted phenyl group.

In the most preferred combinations thereof, the ring L is a benzene ring substituted by a methyl group, $R^{45}$ is an unsubstituted alkyl group having 1 to 4 carbon atoms, and $R^{46}$ is an alkyl group having 1 to 4 carbon atoms and a substituent(s).

Formula (M8)

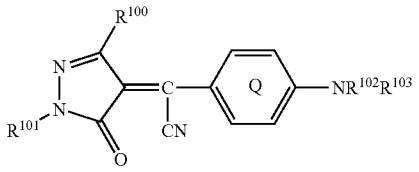

In the formula (M8), the ring Q represents a substituted or unsubstituted benzene ring, $R^{100}$ represents a substituted or unsubstituted alkyl group, a substituted or unsubstituted aryl group, a substituted or unsubstituted alkoxy group, or a substituted or unsubstituted amino group, $R^{101}$ represents a substituted or unsubstituted alkyl group, or a substituted or unsubstituted aryl group, $R^{102}$ and $R^{103}$ each independently represent a hydrogen atom, a substituted or unsubstituted alkyl group, a substituted or unsubstituted alkenyl group, or a substituted or unsubstituted aryl group.

Each of the ring Q and the groups represented by $R^{100}$, $R^{101}$, $R^{102}$ and $R^{103}$ may further have a substituent. Examples of a substituent by which each of the ring Q and the groups of $R^{100}$, $R^{101}$, $R^{102}$ and $R^{103}$ may be substituted include the same substituents as each of the ring A and the substituents $R^1$ to $R^4$ in the formula (Y1) may have.

Examples of a preferred combination of the ring Q and the groups $R^{100}$ to $R^{103}$ in the dye represented by the formula (M8) include combinations wherein the ring Q is a substituted or unsubstituted benzene ring, $R^{102}$ is a substituted or unsubstituted alkyl group: having 1 to 8 carbon atoms, an allyl group, or a substituted or unsubstituted aryl group having 6 to 10 carbon atoms, $R^{103}$ is a substituted or unsubstituted alkyl group having 1 to 8 carbon atoms, an allyl group, or a substituted or unsubstituted aryl group having 6 to 10 carbon atoms, $R^{100}$ is a substituted or unsubstituted amino group, or a substituted or unsubstituted alkoxy group, and $R^{101}$ is a substituted or unsubstituted alkyl group having 1 to 8 carbon atoms, or a substituted or unsubstituted aryl group having 6 to 10 carbon atoms.

In more preferred combinations thereof, the ring Q is a substituted or unsubstituted benzene ring, $R^{102}$ is a substituted or unsubstituted alkyl group having 1 to 6 carbon atoms, an allyl group, or a substituted or unsubstituted phenyl group, $R^{103}$ is a substituted or unsubstituted alkyl group having 1 to 6 carbon atoms, an allyl group, or a substituted or unsubstituted phenyl group, $R^{100}$ is a substituted or unsubstituted amino group, or a substituted or unsubstituted alkoxy group, and $R^{101}$ is a substituted or unsubstituted alkyl group having 1 to 6 carbon atoms, or a substituted or unsubstituted phenyl group.

In the most preferred combinations thereof, the ring Q is a substituted or unsubstituted benzene ring, $R^{102}$ is a substituted or unsubstituted alkyl group having 1 to 4 carbon atoms, or an allyl group, $R^{103}$ is a substituted or unsubstituted alkyl group having 1 to 4 carbon atoms, or an allyl group, $R^{100}$ is a substituted or unsubstituted amino group, or a substituted or unsubstituted alkoxy group, and $R^{101}$ is a substituted or unsubstituted phenyl group.

Formula (C1)

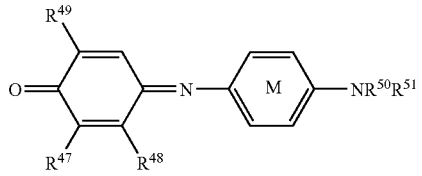

In the formula (C1), the ring M represents a substituted or unsubstituted benzene ring, $R^{47}$ represents a hydrogen atom or a halogen atom, $R^{48}$ represents a substituted or unsubstituted alkyl group, $R^{49}$ represents a substituted or unsubstituted acylamino group or a substituted or unsubstituted alkoxycarbonylamino group, and $R^{50}$ and $R^{51}$ each independently represent a substituted or unsubstituted alkyl group, a substituted or unsubstituted alkenyl group or a substituted or unsubstituted aryl group.

Each of the ring M and the groups represented by $R^{48}$, $R^{49}$, $R^{50}$ and $R^{51}$ may further have a substituent. Examples of a substituent by which each of the ring M and the groups of $R^{48}$, $R^{49}$, $R^{50}$ and $R^{51}$ may be substituted include the same substituents as each of the ring A and the substituents $R^1$ to $R^4$ in the formula (Y1) may have.

Examples of a preferred combination of the ring M and the substituents $R^{47}$ to $R^{51}$ include combinations wherein the ring M is a benzene ring substituted by an alkyl group having 1 to 4 carbon atoms, a benzene ring substituted by a chlorine atom or an unsubstituted benzene ring, $R^{47}$ is a hydrogen atom, a chlorine atom or a bromine atom, $R^{48}$ is a substituted or unsubstituted alkyl group having 1 to 8 carbon atoms, $R^{49}$ is a substituted or unsubstituted acylamino group having 2 to 10 carbon atoms or a substituted or unsubstituted alkoxycarbonylamino group having 2 to 10 carbon atoms, $R^{50}$ is a substituted or unsubstituted alkyl group having 1 to 8 carbon atoms, and $R^{51}$ is a substituted or unsubstituted alkyl group having 1 to 8 carbon atoms.

In preferred combinations of the ring M and the substituents $R^{47}$ to $R^{51}$, the ring M is a benzene ring substituted by an alkyl group having 1 to 2 carbon atoms or an unsubstituted benzene ring, $R^{47}$ is a hydrogen atom or a chlorine atom, $R^{48}$ is a substituted or unsubstituted alkyl group having 1 to 6 carbon atoms, $R^{49}$ is a substituted or unsubstituted acylamino group having 2 to 8 carbon atoms or a substituted or unsubstituted alkoxycarbonylamino group having 2 to 8 carbon atoms, $R^{50}$ is a substituted or unsubstituted alkyl group having 1 to 6 carbon atoms, and $R^{51}$ is a substituted or unsubstituted alkyl group having 1 to 6 carbon atoms.

In the most preferred combinations thereof, the ring M is a benzene ring substituted by a methyl group or an unsubstituted benzene ring, $R^{47}$ is a hydrogen atom or a chlorine atom, $R^{48}$ is a substituted or unsubstituted alkyl group having 1 to 6 carbon atoms, $R^{49}$ is a substituted or unsubstituted acylamino group having 2 to 6 carbon atoms or a substituted or unsubstituted alkoxycarbonylamino group having 2 to 6 carbon atoms, $R^{50}$ is a substituted or unsubstituted alkyl group having 1 to 4 carbon atoms, and $R^{51}$ is a substituted or unsubstituted alkyl group having 1 to 4 carbon atoms.

Formula (C2)

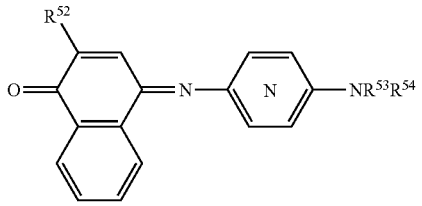

In the formula (C2), the ring N represents a substituted or unsubstituted benzene ring, $R^{52}$ represents a hydrogen atom, a substituted or unsubstituted acylamino group, a substituted or unsubstituted alkoxycarbonyl group, or a substituted or unsubstituted carbamoyl group, and $R^{53}$ and $R^{54}$ each independently represent a substituted or unsubstituted alkyl group, a substituted or unsubstituted alkenyl group, or a substituted or unsubstituted aryl group.

Each of the ring N and the groups represented by $R^{52}$, $R^{53}$ and $R^{54}$ may further have a substituent. Examples of a substituent by which each of the ring N and the groups of $R^{52}$, $R^{53}$ and $R^{54}$ may be substituted include the same substituents as each of the ring A and the substituents $R^1$ to $R^4$ in the formula (Y1) may have.

Examples of a preferred combination of the ring N and the groups $R^{52}$ to $R^{54}$ in the dye represented by the formula (C2) include combinations wherein the ring N is a benzene ring substituted by an alkyl group having 1 to 8 carbon atoms, a benzene ring substituted by an alkoxy group having 1 to 8 carbon atoms, or an unsubstituted benzene ring, $R^{52}$ is a hydrogen atom, a substituted or unsubstituted acylamino group having 2 to 10 carbon atoms, a substituted or unsubstituted alkoxycarbonyl group having 2 to 10 carbon atoms, or a substituted or unsubstituted carbamoyl group having 1 to 10 carbon atoms, $R^{53}$ is a substituted or unsubstituted alkyl group having 1 to 8 carbon atoms, and $R^{54}$ is a substituted or unsubstituted alkyl group having 1 to 8 carbon atoms.

In more preferred combinations thereof, the ring N is a benzene ring substituted by an alkyl group having 1 to 6 carbon atoms, a benzene ring substituted by an alkoxy group having 1 to 6 carbon atoms, or an unsubstituted benzene ring, $R^{52}$ is a hydrogen atom, a substituted or unsubstituted acylamino group having 2 to 8 carbon atoms, a substituted or unsubstituted alkoxycarbonyl group having 2 to 8 carbon atoms, or a substituted or unsubstituted carbamoyl group having 1 to 8 carbon atoms, $R^{53}$ is a substituted or unsubstituted alkyl group having 1 to 6 carbon atoms, and $R^{54}$ is a substituted or unsubstituted alkyl group having 1 to 6 carbon atoms.

In the most preferred combinations thereof, the ring N is a benzene ring substituted by an alkyl group having 1 to 4 carbon atoms, a benzene ring substituted by an alkoxy group having 1 to 4 carbon atoms, or an unsubstituted benzene ring, $R^{52}$ is a hydrogen atom, a substituted or unsubstituted acylamino group having 2 to 6 carbon atoms, a substituted or unsubstituted alkoxycarbonyl group having 2 to 6 carbon atoms, or a substituted or unsubstituted carbamoyl group having 1 to 6 carbon atoms, $R^{53}$ is a substituted or unsubstituted alkyl group having 1 to 4 carbon atoms, and $R^{54}$ is a substituted or unsubstituted alkyl group having 1 to 4 carbon atoms.

Formula (C3)

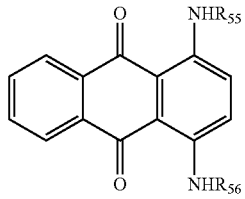

In the formula (C3), $R^{55}$ and $R^{56}$ each independently represent an alkyl group, or a substituted or unsubstituted aryl group.

Each of the groups represented by $R^{55}$ and $R^{56}$ may further have a substituent. Examples of a substituent by which each of the groups of $R^{55}$ and $R^{56}$ may be substituted include the same substituents as each of the ring A and the substituents $R^1$ to $R^4$ in the formula (Y1) may have.

Examples of a preferred combination of the substituents $R^{55}$ and $R^{56}$ in a dye represented by the formula (C3) include combinations wherein $R^{55}$ is a substituted or unsubstituted alkyl group having 1 to 8 carbon atoms or a substituted or unsubstituted aryl group having 6 to 10 carbon atoms, $R^{56}$ is a substituted or unsubstituted alkyl group having 1 to 8 carbon atoms or a substituted or unsubstituted aryl group having 6 to 10 carbon atoms.

In more preferred combinations of the substituents $R^{55}$ and $R^{56}$, $R^{55}$ is a substituted or unsubstituted alkyl group having 1 to 6 carbon atoms or a substituted or unsubstituted phenyl group, $R^{56}$ is a substituted or unsubstituted alkyl group having 1 to 6 carbon atoms or a substituted or unsubstituted phenyl group.

In the most preferred combinations thereof, $R^{55}$ is a substituted or unsubstituted alkyl group having 1 to 4 carbon atoms, $R^{56}$ is a substituted or unsubstituted alkyl group having 1 to 4 carbon atoms or a substituted or unsubstituted phenyl group.

Formula (C4)

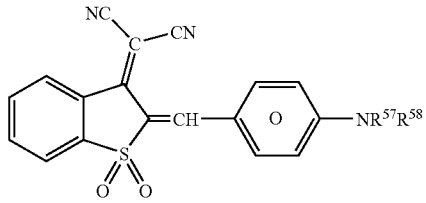

In the formula (C4), the ring O represents a substituted or unsubstituted benzene ring, and $R^{57}$ and $R^{58}$ each independently represent a substituted or unsubstituted alkyl group, a substituted or unsubstituted alkenyl group, or a substituted or unsubstituted aryl group.

Each of the ring O and the groups represented by $R^{57}$ and $R^{58}$ may further have a substituent. Examples of a substituent by which each of the ring O and the groups of $R^{57}$ and $R^{58}$ may be substituted include the same substituents as each of the ring A and the substituents $R^1$ to $R^4$ in the formula (Y1) may have.

Examples of a preferred combination of the ring O and the groups $R^{57}$ and $R^{58}$ in the dye represented by the formula (C4) include combinations wherein the ring O is a benzene ring substituted by an alkyl group having 1 to 8 carbon atoms, a benzene ring substituted by an alkoxy group having 1 to 8 carbon atoms, or an unsubstituted benzene ring, $R^{57}$ is a substituted or unsubstituted alkyl group having 1 to 8 carbon atoms, and $R^{58}$ is a substituted or unsubstituted alkyl group having 1 to 8 carbon atoms.

In more preferred combinations thereof, the ring O is a benzene ring substituted by an alkyl group having 1 to 6 carbon atoms, a benzene ring substituted by an alkoxy group having 1 to 6 carbon atoms, or an unsubstituted benzene ring, $R^{57}$ is a substituted or unsubstituted alkyl group having 1 to 6 carbon atoms, and $R^{58}$ is a substituted or unsubstituted alkyl group having 1 to 6 carbon atoms.

In the most preferred combinations thereof, the ring O is a benzene ring substituted by an alkyl group having 1 to 4 carbon atoms, a benzene ring substituted by an alkoxy group having 1 to 4 carbon atoms, or an unsubstituted benzene ring, $R^{57}$ is a substituted or unsubstituted alkyl group having 1 to 4 carbon atoms, and $R^{58}$ is a substituted or unsubstituted alkyl group having 1 to 4 carbon atoms.

Specific examples of compounds as the dyes represented by the formulae (Y1) to (Y9), (M1) to (M8) and (C1) to (C4), which can be preferably used in the invention, are illustrated below. However, the dyes represented by the formulae (Y1) to (Y9), (M1) to (M8) and (C1) to (C4) used in the invention should not be restrictedly interpreted by the specific examples illustrated below.

TABLE 1

The dyes represented by the formula (Y1)

| Examples of compounds | Ring A | $R^1$ | $R^2$ | $R^3$ | $R^4$ |
|---|---|---|---|---|---|
| Y1-1 | 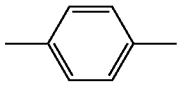 | Ethyl | Ethyl | Ethoxy | Phenyl |
| Y1-2 | 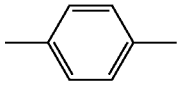 | Ethyl | Ethyl | Dimethylamino | Phenyl |
| Y1-3 | 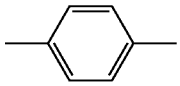 | n-Propyl | n-Propyl | Ethoxy | Phenyl |
| Y1-4 | 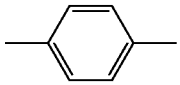 | n-Butyl | n-Butyl | Ethoxy | Phenyl |

TABLE 2

The dyes represented by the formula (Y2)

| Examples of compounds | $R^5$ | $R^6$ | $R^7$ | $R^8$ | $R^9$ |
|---|---|---|---|---|---|
| Y2-1 | Ethyl | Methyl | Methyl | Dimethylamino | Phenyl |
| Y2-2 | n-Propyl | Methyl | Methyl | Dimethylamino | Phenyl |
| Y2-3 | Allyl | Methyl | Methyl | Dimethylamino | Phenyl |
| Y2-4 | Ethyl | Methyl | Methyl | Ethoxy | Phenyl |

TABLE 3

The dyes represented by the formula (Y3)

| Examples of compounds | $R^{10}$ | $R^{11}$ | $R^{12}$ |
|---|---|---|---|
| Y3-1 | Isopropyl | Hydrogen | Di-n-butyl-carbamoyl |
| Y3-2 | Hydrogen | Bromo | Di-n-propyl-carbamoyl |

TABLE 4

The dyes represented by the formula (Y4)

| Examples of compounds | Ring B | $R^{13}$ | $R^{14}$ |
|---|---|---|---|
| Y4-1 | 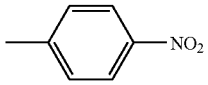 | t-Butyl | Phenyl |

TABLE 4-continued

The dyes represented by the formula (Y4)

| Examples of compounds | Ring B | $R^{13}$ | $R^{14}$ |
|---|---|---|---|
| Y4-2 | 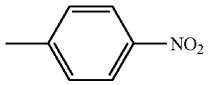 | t-Butyl | Methyl |
| Y4-3 | 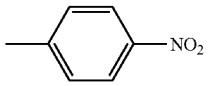 | t-Butyl | 4-(Ethoxycarbonyl) phenyl |

TABLE 5

The dyes represented by the formula (Y5)

| Examples of compounds | $R^{15}$ | $R^{16}$ | $R^{17}$ | $R^{18}$ |
|---|---|---|---|---|
| Y5-1 | Methyl | Methyl | Phenyl | Phenyl |
| Y5-2 | Methyl | Methyl | Methyl | Methyl |

TABLE 6

The dyes represented by the formula (Y6)

| Examples of compounds | Ring C | Ring D | Ring B |
|---|---|---|---|
| Y6-1 | 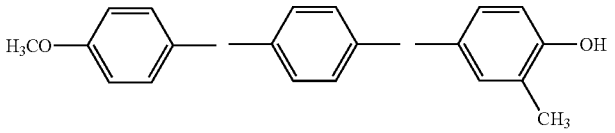 | | |
| Y6-2 | 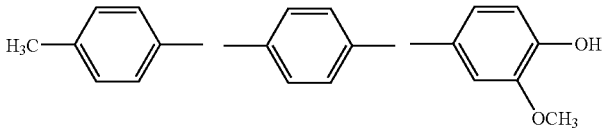 | | |

TABLE 7

The dyes represented by the formula (Y7)

| Examples of compounds | Ring F | $R^{19}$ | $R^{20}$ |
|---|---|---|---|
| Y7-1 | 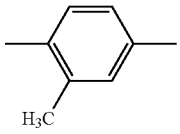 | n-Butyl | Benzyl |
| Y7-2 | 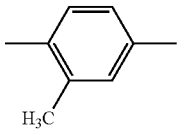 | Ethyl | 4-Cyclohexyl phenoxyethyl |
| Y7-3 | 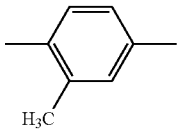 | Ethyl | Phenethyl |
| Y7-4 | 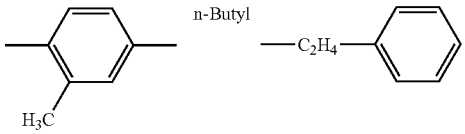 | n-Butyl | |

TABLE 8

The dyes represented by the formula (Y8)

| Examples of compounds | Ring G | $R^{21}$ | $R^{22}$ |
|---|---|---|---|
| Y8-1 | 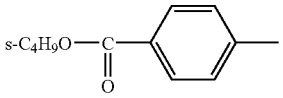 | Methyl | s-Butyl |
| Y8-2 | 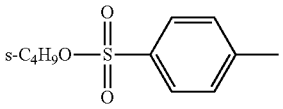 | Methyl | t-Pentyl |

TABLE 9

The dyes represented by the formula (Y9)

| Examples of compounds | $R^{23}$ |
|---|---|
| Y9-1 | Ethyl |
| Y9-2 | n-Propyl |
| Y9-3 | n-Butyl |

TABLE 10

The dyes represented by the formula (M1)

| Examples of compounds | Ring H | $R^{24}$ | $R^{25}$ | $R^{26}$ | $R^{27}$ |
|---|---|---|---|---|---|
| M1-1 | | 2-Chlorophenyl | Isopropyl | n-Butyl | Cyanoethyl |
| M1-2 | | 2-Chlorophenyl | Isopropyl | Acetoxyethyl | Acetoxyethyl |
| M1-3 | | 2-Chloropheny | Isopropyl | n-Butyl | 4-Methoxy phenoxyethyl |

TABLE 11

The dyes represented by the formula (M2)

| Examples of compounds | Ring I | $R^{28}$ | $R^{29}$ | $R^{30}$ | $R^{31}$ |
|---|---|---|---|---|---|
| M2-1 | N, $H_3C$ | t-Butyl | 3-Methylphenyl | Ethyl | Ethyl |
| M2-2 | | 2-Chlorophenyl | Isopropyl | n-Butyl | Cyanoethyl |

TABLE 12

The dyes represented by the formula (M3)

| Examples of compounds | Ring J | $R^{32}$ | $R^{33}$ | $R^{34}$ |
|---|---|---|---|---|
| M3-1 | HN, O, $H_3C$ | n-Butyl | n-Butyl | n-Butyl |
| M3-2 | HN, O, $H_3C$ | Allyl | n-Propyl | n-Propyl |

TABLE 13

The dyes represented by the formula (M4)

| Examples of compounds | Ring K | $R^{35}$ | $R^{36}$ | $R^{37}$ |
|---|---|---|---|---|
| M4-1 | HN, O, $H_3C$ | Methyl | Ethyl | Benzyl |
| M4-2 | HN, O, $H_3C$—CH, $CH_3$ | Methyl | Ethyl | Benzyl |

TABLE 14

The dyes represented by the formula (M5)

| Examples of compounds | $R^{38}$ | $R^{39}$ | $R^{40}$ | $R^{41}$ |
|---|---|---|---|---|
| M5-1 | Methyl | t-Butyl | Ethyl | Ethyl |
| M5-2 | Phenyl | t-Butyl | Ethyl | Ethyl |
| M5-3 | Methyl | t-Butyl | n-Propyl | n-Propyl |
| M5-4 | Methyl | t-Butyl | n-Butyl | n-Butyl |

TABLE 15

The dyes represented by the formula (M6)

| Examples of compounds | $R^{42}$ | $R^{43}$ | $R^{44}$ |
|---|---|---|---|
| M6-1 | Phenoxy | Hydrogen | Hydroxyl |
| M6-2 | Phenoxy | Phenoxy | Amino |
| M6-3 | m-(N-Methylamino)phenyl | Hydrogen | Hydroxyl |

TABLE 16

The dyes represented by the formula (M7)

| Examples of compounds | Ring L | $R^{45}$ | $R^{46}$ |
|---|---|---|---|
| M7-1 | 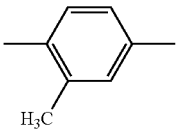 | Ethyl | Ethyl |

TABLE 16-continued

The dyes represented by the formula (M7)

| Examples of compounds | Ring L | $R^{45}$ | $R^{46}$ |
|---|---|---|---|
| M7-2 | 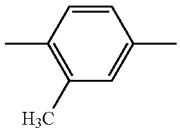 | n-Propyl | n-Propyl |

TABLE 17

The dyes represented by the formula (M8)

| Examples of compounds | Ring Q | $R^{100}$ | $R^{101}$ | $R^{102}$ | $R^{103}$ |
|---|---|---|---|---|---|
| M8-1 | 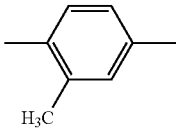 | Dimethyl-amino | Phenyl | Ethyl | Ethyl |
| M8-2 | 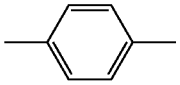 | Dimethyl-amino | Phenyl | Ethyl | Ethyl |
| M8-3 | 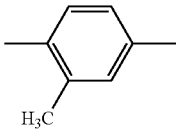 | Ethoxy | Phenyl | Ethyl | Ethyl |
| M8-4 | 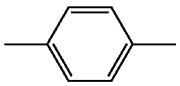 | Ethoxy | Phenyl | Ethyl | Ethyl |

TABLE 18

The dyes represented by the formula (C1)

| Examples of compounds | Ring M | $R^{47}$ | $R^{48}$ | $R^{49}$ | $R^{50}$ | $R^{51}$ |
|---|---|---|---|---|---|---|
| C1-1 | 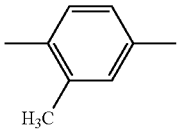 | Chloro | Methyl | Acetylamino | Ethyl | Ethyl |
| C1-2 | 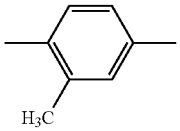 | Hydrogen | Methyl | Acetylamino | Ethyl | Ethyl |
| C1-3 | 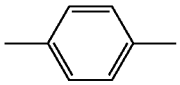 | Chloro | Hydrogen | 3-Pyridine carbonylamino | n-Propyl | n-Propyl |

TABLE 18-continued

The dyes represented by the formula (C1)

| Examples of compounds | Ring M | $R^{47}$ | $R^{48}$ | $R^{49}$ | $R^{50}$ | $R^{51}$ |
|---|---|---|---|---|---|---|
| C1-4 | | Chloro | Methyl | Acetylamino | n-Propyl | n-Propyl |
| C1-5 | $H_3C$ | Chloro | Ethyl | 2-Furoylamino | Ethyl | Ethyl |

TABLE 19

The dyes represented by the formula (C2)

| Examples of compounds | Ring N | $R^{52}$ | $R^{53}$ | $R^{54}$ |
|---|---|---|---|---|
| C2-1 | $H_3C$ | Dimethyl-carbamoyl | Ethyl | Benzyl |
| C2-2 | $H_3C$ | Acetylamino | Ethyl | Ethyl |
| C2-3 | | Hydrogen | Ethyl | Isopropyl |
| C2-4 | $H_3CO$ | Ethoxycarbonyl | Ethyl | Ethyl |
| C2-5 | | Hydrogen | Ethyl | Ethyl |

TABLE 20

The dyes represented by the formula (C3)

| Examples of compounds | $R^{55}$ | $R^{56}$ |
|---|---|---|
| C3-1 | Isopropyl | Isopropyl |
| C3-2 | Methyl | m-Toluyl |
| C3-3 | m-Toluyl | m-Toluyl |

TABLE 21

The dyes represented by the formula (C4)

| Examples of compounds | $R^{57}$ | $R^{58}$ |
|---|---|---|
| C4-1 | Ethyl | Ethyl |
| C4-2 | n-Propyl | n-Propyl |
| C4-3 | n-Butyl | n-Butyl |

<Binder>

The resin binder contained in the dye layer in the invention may be known one. Examples thereof include acrylic resins such as polyacrylonitrile, polyacrylate, and polyacrylamide; polyvinyl acetal resins such as polyvinyl acetoacetal, and polyvinyl butyral; cellulose resins such as ethylcellulose, hydroxyethylcellulose, ethylhydroxycellulose, hydroxypropylcellulose, ethylhydroxyethylcellulose, methylcellulose, cellulose acetate, cellulose acetate butyrate, cellulose acetate propionate, cellulose nitrate, other modified cellulose resins, nitrocellulose, and ethylhydroxyethylcellulose; other resins such as polyurethane resin, polyamide resin, polyester resin, polycarbonate resin, phenoxy resin, phenol resin, and epoxy resin; and various elastomers. The dye layer may be made of at least one resin selected from the above-mentioned group.

These may be used alone, or two or more thereof may be used in the form of a mixture or copolymer. These may be crosslinked with various crosslinking agents.

The binder in the invention is preferably a cellulose resin or a polyvinyl acetal resin, more preferably a polyvinyl acetal resin. In the invention, the binder resin is in particular preferably polyvinyl acetoacetal resin, or polyvinyl butyral resin.

In the heat-sensitive transfer sheet used in the invention, a dye barrier layer may be formed between the dye layer and the base film.

The surface of the base film may be subjected to treatment for easy adhesion to improve the wettability and the adhesive property of the coating liquid. Examples of the treatment include corona discharge treatment, flame treatment, ozone treatment, ultraviolet treatment, radial ray treatment, surface-roughening treatment, chemical agent treatment, vacuum plasma treatment, atmospheric plasma treatment, primer treatment, grafting treatment, and other known surface modifying treatments.

An easily-adhesive layer may be formed on the base film by coating. Examples of the resin used in the easily-adhesive layer include polyester resins, polyacrylate resins, polyvinyl acetate resins, vinyl resins such as polyvinyl chloride resin and polyvinyl alcohol resin, polyvinyl acetal resins such as polyvinyl acetoacetal and polyvinyl butyral, polyether resins, polyurethane resins, styrene acrylate resins, polyacrylamide resins, polyamide resins, polystyrene resins, polyethylene resins, and polypropylene resins.

When a film used for the base film is formed by melt extrusion, it is allowable to subject a non-drawn film to coating treatment followed by drawing treatment.

The above-mentioned treatments may be used in combination of two or more thereof.

(Transferable Protective Layer Laminate)

In the invention, a transferable protective layer laminate is preferably formed in area order onto the heat-sensitive transfer sheet. The transferable protective layer laminate is used to protect a heat-transferred image with a protective layer composed of a transparent resin, thereby to improve durability such as scratch resistance, light-fastness, and resistance to weather. This laminate is effective for a case where the transferred dye is insufficient in image durabilities such as light resistance, scratch resistance, and chemical resistance in the state that the dye is naked in the surface of an image-receiving sheet.

The transferable protective layer laminate can be formed by forming, onto a support, a releasing layer, a protective layer and an adhesive layer in this order (i.e., in the layer-described order) successively. The protective layer may be formed by plural layers. In the case where the protective layer also has functions of other layers, the releasing layer and the adhesive layer can be omitted. It is also possible to use a base film on which an easy adhesive layer has already been formed.

(Transferable Protective Layer)

As a transferable protective layer-forming resin, preferred are resins that are excellent in scratch resistance, chemical resistance, transparency and hardness. Examples of the resin include polyester resins, polystyrene resins, acrylic resins, polyurethane resins, acrylic urethane resins, silicone-modified resins of the above-described resins, ultraviolet-shielding resins, mixtures of these resins, ionizing radiation-curable resins, and ultraviolet-curing resins. Particularly preferred are polyester resins and acrylic resins.

These resins may be crosslinked with various crosslinking agents.

The method for forming the protective layer, which depends on the kind of the resin to be used, may be the same method for forming the dye layer. The protective layer preferably has a thickness of 0.5 to 10 μm.

(Releasing Layer)

In a case where the protective layer is not easily peeled from the support in the protective layer transferring sheet when the image is thermally transferred, a releasing layer may be formed between the support and the protective layer. A peeling layer may be formed between the transferable protective layer and the releasing layer. The releasing layer may be formed by painting a coating liquid by a method known in the prior art, such as gravure coating or gravure reverse coating, and then drying the painted liquid. The coating liquid contains at least one selected from, for example, waxes, silicone waxes, silicone resins, fluorine-contained resins, acrylic resins, polyvinyl alcohol resins, cellulose derivative resins, urethane resins, vinyl acetate resins, acryl vinyl ether resins, maleic anhydride resins, and copolymers of these resins. Of these resins, preferred are: acrylic resins, such as resin obtained by homopolymerizing a (meth)acrylic monomer such as acrylic acid or methacrylic acid, or obtained by copolymerizing a methacrylic monomer with a different monomer; or cellulose derivative resins. They are each excellent in adhesive property to the support, and releasing ability from the protective layer.

These resins may be crosslinked with various crosslinking agents. Moreover, ionizing radiation curable resin and ultraviolet curable resin may be used.

The releasing layer may be appropriately selected from a releasing layer which is transferred to a transferred-image-receiving member when the image is thermally transferred, a releasing layer which remains on the support side at that time, a releasing layer which is broken out by aggregation at that time, and other releasing layers. A preferred embodiment of the invention is an embodiment wherein the releasing layer remains on the support side at the time of the thermal transfer and the interface between the releasing layer and the thermally transferable protective layer becomes a protective layer surface after the thermal transfer since the embodiment is excellent in surface gloss, the transfer stability of the protective layer, and others. The method for forming the releasing layer may be a painting method known in the prior art. The releasing layer preferably has a thickness of about 0.5 to 5 μm in the state that the layer is dried.

(Adhesive Layer)

An adhesive layer may be formed, as the topmost layer of the transferable protective layer laminate, on the topmost surface of the protective layer. This makes it possible to make the adhesive property of the protective layer to a transferred-image-receiving member good.

According to the present invention, it is possible to provide a heat-sensitive transfer image forming method, whereby a high quality image print can be obtained stably regardless of various printer fixations at a high-speed printing, and even though the period of exchange of the thermal head is extended, neither scar of the print nor disconnection of the thermal head occurs.

The present invention will be described in more detail based on the following examples, but the invention is not intended to be limited thereto. In the following examples, the terms "part(s)" and "%" are values by mass, unless otherwise specified.

EXAMPLES

Production of Heat-sensitive Transfer Sheets

As a support, prepared was a polyester film, 4.5 μm in thickness, having a single surface subjected to treatment for easy adhesion, and then a heat-resistant-lubricating-layer-coating liquid, which will be detailed later, was painted onto the surface of the film not subjected to the treatment for easy adhesion so that the solid coating amount would be 1.1 g/m$^2$ after the liquid was dried. In the heat-resistant-lubricating-layer-coating liquid, the ratio by mole of reactive groups of polyisocyanate to those of the resin (—NCO/OH) was 0.9. After the painting, the workpiece was dried, and subsequently subjected to heat treatment at 55° C. for 10 days under low humidity so as to conduct crosslinking reaction between the isocyanate and the polyol. In this way, the workpiece was cured.

Coating liquids, which will be detailed later, were used to form, onto the easily-adhesive layer painted surface of the thus-formed polyester film, individual heat-sensitive transfer layers in yellow, magenta and cyan, and a transferable protective layer laminate in area order by painting. In this way, a heat-sensitive transfer sheet was produced. The solid coating amount in each of the heat-sensitive transfer layers (dye layers) was set to 0.8 g/m$^2$.

In the formation of the transferable protective layer laminate, a releasing-layer-coating liquid was applied, and a protective-layer-coating liquid was applied thereon. The resultant was dried, and then an adhesive-layer-coating liquid was applied thereon. The resultant was then dried. In this way, a heat-sensitive transfer sheet (T-1) was formed.

| Heat-resistant-lubricating-layer-coating liquid | |
|---|---|
| Acrylic polyol resin | 27.0 mass parts |
| Phosphate ester (trade name: Phoslex A18, manufactured by Sakai Chemical Industry Co., Ltd.) | 0.8 mass part |
| Phosphate ester (trade name: PLYSURF A208N, manufactured by Dai-ichi Kogyo Seiyaku Co., Ltd.) | 6.5 mass parts |
| Zinc stearylphosphate | 0.6 mass part |
| Zinc stearate | 0.6 mass part |
| Talc | 0.5 mass part |
| Polyisocyanate (50% solution) (trade name: BIRNOCK D-750, manufactured by Dainippon Ink & Chemicals, Inc.) | 12.0 mass parts |
| Methyl ethyl ketone/toluene mixed solvent | 52 mass parts |
| **Yellow-dye-coating liquid** | |
| Dye compound (Y4-2) | 2.8 mass parts |
| Dye compound (Y7-4) | 5.8 mass parts |
| Polyvinylacetal resin (trade name: ESLEC KS-1, manufactured by Sekisui Chemical Co., Ltd.) | 7.6 mass parts |
| Polyvinylbutyral resin (trade name: DENKA BUTYRAL #6000-C, manufactured by DENKI KAGAKU KOGYOU K. K.) | 0.2 mass part |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/toluene mixtured solvent | 83 mass parts |
| **Magenta-dye-coating liquid** | |
| Dye compound (M3-1) | 2.0 mass parts |
| Dye compound (M3-2) | 6.5 mass parts |
| Dye compound (C1-2) | 0.3 mass part |
| Polyvinylacetal resin (trade name: ESLEC KS-1, manufactured by Sekisui Chemical Co., Ltd.) | 8.0 mass parts |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/toluene mixtured solvent | 83 mass parts |
| **Cyan-dye-coating liquid** | |
| Dye compound (C1-2) | 2.0 mass parts |
| Dye compound (C3-1) | 7.9 mass parts |
| Polyvinylacetal resin (trade name: ESLEC KS-1, manufactured by Sekisui Chemical Co., Ltd.) | 7.0 mass parts |
| Releasing agent (trade name: X-22-3000T, manufactured by Shin-Etsu Chemical Co., Ltd.) | 0.02 mass part |
| Releasing agent (trade name: TSF4701, manufactured by MOMENTIVE Performance Materials Japan LLC.) | 0.02 mass part |

-continued

| | |
|---|---|
| Matting agent (trade name: Flo-thene UF, manufactured by Sumitomo Seika Chemicals Co., Ltd.) | 0.2 mass part |
| Methyl ethyl ketone/toluene mixtured solvent | 83 mass parts |

(Transfer Protective Layer Laminate)

On the polyester film coated with the dye layers as described above, coating solutions of a releasing layer, a protective layer and an adhesive layer each having the following composition was coated, to form a transfer protective layer laminate. Coating amounts of the releasing layer, the protective layer and the adhesive layer after drying were 0.2 g/m$^2$, 0.8 g/m$^2$ and 2.0 g/m$^2$, respectively.

| Releasing-layer-coating liquid | |
|---|---|
| Modified cellulose resin (trade name: L-30, manufactured by DAICEL CHEMICAL INDUSTRIES, LTD.) | 5.0 mass parts |
| Methyl ethyl ketone/toluene mixtured solvent | 95.0 mass parts |
| **Protective-layer-coating liquid** | |
| Acrylic resin (trade name: DIANAL BR-100, manufactured by MITSUBISHI RAYON CO., LTD.) | 30 mass parts |
| Isopropanol | 70 mass parts |
| **Adhesive-layer-coating liquid** | |
| Acrylic resin (trade name: DIANAL BR-77, manufactured by MITSUBISHI RAYON CO., LTD.) | 25 mass parts |
| The following ultraviolet absorber UV-1 | 1.5 mass parts |
| The following ultraviolet absorber UV-2 | 2 mass parts |
| The following ultraviolet absorber UV-3 | 0.9 mass part |
| The following ultraviolet absorber UV-4 | 0.3 mass part |
| PMMA fine particles (polymethyl methacrylate fine particles) | 0.3 mass part |
| Methyl ethyl ketone/toluene mixtured solvent | 70 mass parts |

(UV-1)

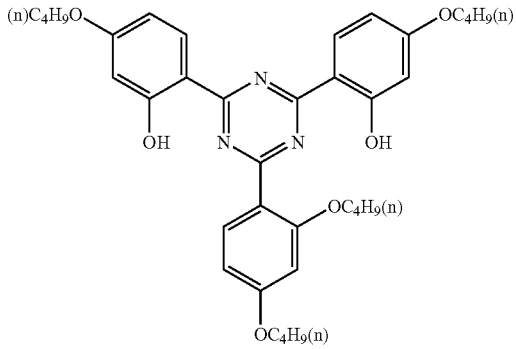

(UV-2)

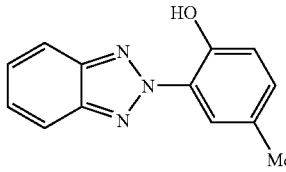

(UV-3)

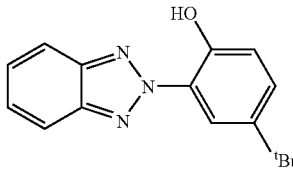

-continued

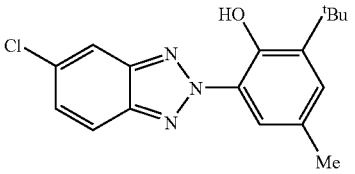

(UV-4)

Heat-sensitive transfer sheets (T-2) to (T-4) were each produced in the same way as in the production of the heat-sensitive transfer sheet (T-1) except that inorganic particles were incorporated into the heat-resistant lubricating layer. The structure of the inorganic particles in the heat-resistant lubricating layer of each of these heat-sensitive transfer sheets is shown in Table 22.

TABLE 22

| Inorganic particles in heat-resistant lubricating layer | | | | | |
|---|---|---|---|---|---|
| Sample name | Material (Mohs' hardness) | Particulate form | Mean ratio of particle maximum width to sphere equivalent diameter | Mean particle size | Content by percentage (mass %) |
| T-1 | Talc (1) | Tabular form | 4.2 | 4.0 μm | 1.2 |
| T-2 | Talc (1) | Tabular form | 4.2 | 5.2 μm | 1.2 |
| | Magnesium oxide (4) | Tabular form | 6.2 | 1.3 μm | 0.4 |
| T-3 | Talc (1) | Tabular form | 4.2 | 4.0 μm | 1.2 |
| | Magnesium oxide (4) | Cubic form | 1.4 | 1.8 μm | 0.4 |
| T-4 | Talc (1) | Tabular form | 4.2 | 4.0 μm | 1.2 |
| | Silica (7) | Indeterminate form | 20.8 | 1.2 μm | 0.4 |

(Preparation of Heat Sensitive Image-receiving Sheet Z-1)

A synthetic paper (trade name: Yupo FPG 200, manufactured by Yupo Corporation, thickness: 200 μm) was used as the support; and, on one surface of the support, a white interlayer and a receptor layer, having the following compositions, were coated in this order by a bar coater. The coating was carried out such that the amount of the white interlayer and the amount of the receptor layer after each layer was dried would be 1.0 g/m$^2$ and 4.0 g/m$^2$, respectively, and these layers were respectively dried. Thereafter, the final coating product was processed to a shape in conformity with setting of the printer to prepare a heat-sensitive transfer image-receiving sheet (Z-1).

| White interlayer | |
|---|---|
| Polyester resin (Tg 67° C.) (Trade name: Vylon 200, manufactured by Toyobo Co., Ltd.) | 10 mass parts |
| Fluorescent whitening agent (Trade name: Uvitex OB, manufactured by Ciba-Geigy) | 1 mass part |
| Titanium oxide | 30 mass parts |
| Methyl ethyl ketone/toluene (1/1, at mass ratio) | 90 mass parts |
| **Receptor layer** | |
| Vinyl chloride/vinyl acetate resin (Tg 76° C.) (Trade name: Solbin A, manufactured by Nisshin Chemicals Co., Ltd.) | 100 mass parts |
| Amino-modified silicone (Trade name: X22-3050C, manufactured by Shin-Etsu Chemical Co., Ltd.) | 5 mass parts |
| Epoxy-modified silicone (Trade name: X22-3000E, manufactured by Shin-Etsu Chemical Co., Ltd.) | 5 mass parts |
| Methyl ethyl ketone/toluene (1/1, at mass ratio) | 400 mass parts |

(Preparation of Heat Sensitive Image-receiving Sheet Z-2)

A paper support, on both sides of which polyethylene was laminated, was subjected to corona discharge treatment on the surface thereof, and then a gelatin undercoat layer containing sodium dodecylbenzenesulfonate was disposed on the treated surface. The subbing layer, the heat insulation layer, the lower receptor layer and the upper receptor layer each having the following composition were simultaneously multilayer-coated on the gelatin undercoat layer, in the state that the subbing layer, the heat insulation layer, the lower receptor layer and the upper receptor layer were laminated in this order from the side of the support, by a method illustrated in FIG. 9 in U.S. Pat. No. 2,761,791. The coating was performed so that coating amounts of the subbing layer, the heat insulation layer, the lower receptor layer, and the upper receptor layer after drying would be 6.0 g/m$^2$, 8.5 g/m$^2$, 2.4 g/m$^2$ and 3.0 g/m$^2$, respectively. After drying, the resultant coating product was subjected to a heat treatment at 30° C. for 5 days to complete a cross-linking reaction of gelatin with a cross-linking agent. Thereafter, the final coating product was processed to a shape in conformity with setting of the printer to prepare a heat-sensitive transfer image-receiving sheet (Z-2).

| Upper receptor layer | |
|---|---|
| Vinyl chloride-series latex (Tg 73° C.) (trade name: Vinybran 900, manufactured by Nisshin Chemicals Co., Ltd.) | 21.0 mass parts |
| Vinyl chloride-series latex (Tg 33° C.) (trade name: Vinybran 276, manufactured by Nisshin Chemicals Co., Ltd.) | 1.6 mass parts |
| Gelatin (10% solution) | 2.5 mass parts |
| The following ester-series wax EW-1 | 1.8 mass parts |
| The following surfactant F-1 | 0.1 mass part |
| The following surfactant F-2 | 0.4 mass part |

-continued

| Lower receptor layer | |
|---|---|
| Vinyl chloride-series latex (Tg 46° C.) (trade name: Vinybran 690, manufactured by Nisshin Chemicals Co., Ltd.) | 18.0 mass parts |
| Vinyl chloride-series latex (Tg 73° C.) (trade name: Vinybran 900, manufactured by Nisshin Chemicals Co., Ltd.) | 8.0 mass parts |
| Gelatin (10% solution) | 8.0 mass parts |
| The following surfactant F-1 | 0.03 mass part |
| **Heat insulation layer** | |
| Acryl styrene-series hollow polymer particles (trade name: MH5055, manufactured by Nippon Zeon Co., Ltd., mean particle size 0.5 μm) | 66.0 mass parts |
| Gelatin (10% solution) | 24.0 mass parts |
| Sodium salt of 2,4-dichloro-6-hydroxy-s-triazine (crosslinking agent) | 0.1 mass part |
| **Subbing layer** | |
| Polyvinyl alcohol (trade name: POVAL PVA 205, manufactured by Kuraray) | 7.0 mass parts |
| Styrene butadiene rubber latex (trade name: SN-307, manufactured by NIPPON A & L INC) | 55.0 mass parts |
| The following surfactant F-1 | 0.02 mass part |

(EW-1)

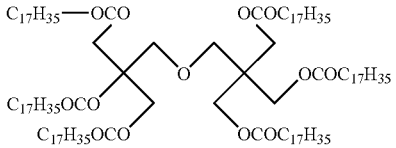

(F-1)

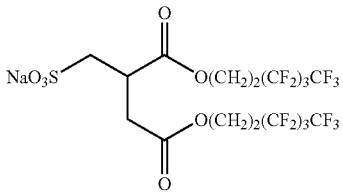

F-2

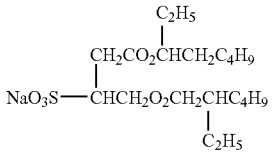

(Preparation of Heat Sensitive Image-receiving Sheet Z-3)

In place of the subbing layer, the heat insulation layer, the lower receptor layer and the upper receptor layer of the heat-sensitive transfer image-receiving sheet (Z-2), the subbing layer, the heat insulation layer, and the receptor layer set forth below were superposed in this order from the support, and in such a disposition, a simultaneous multilayer coating was performed according to a method exemplified in FIG. 9 of U.S. Pat. No. 2,761,791. The coating was performed so that coating amounts of the subbing layer, the heat insulation layer, interlayer and the receptor layer after drying would be 6.0 g/m$^2$, 7.9 g/m$^2$, 4.0 g/m$^2$ and 2.0 g/m$^2$, respectively. After drying, the resultant coating product was subjected to a heat treatment at 30° C. for 5 days to complete a cross-linking reaction of gelatin with a cross-linking agent. Thereafter, the final coating product was processed to a shape in conformity with setting of the printer to prepare a heat-sensitive transfer image-receiving sheet (Z-3).

| Receptor layer | |
|---|---|
| Vinyl chloride-series latex (Tg 46° C.) (trade name: Vinybran 690, manufactured by Nisshin Chemicals Co., Ltd.) | 22.0 mass parts |
| Gelatin (10% solution) | 3.0 mass parts |
| The following ester-series wax EW-1 | 1.8 mass parts |
| The following surfactant F-1 | 0.1 mass part |
| The following surfactant F-2 | 0.4 mass part |
| **Interlayer 2** | |
| Vinyl chloride-series latex (Tg 46° C.) (trade name: Vinybran 690, manufactured by Nisshin Chemicals Co., Ltd.) | 37.0 mass parts |
| Hollow polymer particles containing a styrene/acrylic copolymer as a main component (mean particle size 1.0 μm) | 24.0 mass parts |
| Gelatin (10% solution) | 30.0 mass parts |
| The following surfactant F-1 | 0.02 mass part |
| **Heat insulation layer** | |
| Hollow polymer particles containing a styrene/acrylic copolymer as a main component (mean particle size 1.0 μm) | 58.0 mass parts |
| Gelatin (10% solution) | 28.0 mass parts |
| Sodium salt of 2,4-dichloro-6-hydroxy-s-triazine (crosslinking agent) | 0.2 mass part |
| **Interlayer 1** | |
| Polyvinyl alcohol (trade name: POVAL PVA 205, manufactured by Kuraray) | 7.0 mass parts |
| Methyl methacrylate butadiene rubber latex (trade name: MR-171, manufactured by NIPPON A & L INC) | 55.0 mass parts |
| The following surfactant F-1 | 0.02 mass part |

(Preparation of Heat Sensitive Image-receiving Sheets (Z-4) to (Z-6))

A heat-sensitive transfer image-receiving sheet (Z-4) was prepared in the same manner as the heat-sensitive transfer image-receiving sheet (Z-3), except that a half of the vinyl chloride-series latex used in each of the receptor layer and the interlayer 2 was each replaced by the vinyl chloride-series latex having the Tg of 73° C. (trade name, Vinybran 900, manufactured by Nissin Chemicals Co., Ltd.) Besides, a heat-sensitive transfer image-receiving sheet (Z-5) was prepared in the same manner as the heat-sensitive transfer image-receiving sheet (Z-2), except that the vinyl chloride-series latex having the Tg of 33° C. used in the upper receptor layer and the vinyl chloride-series latex having the Tg of 46° C. used in the lower receptor layer were each replaced in an equivalent amount by the vinyl chloride-series latex having the Tg of 73° C. (trade name, Vinybran 900, manufactured by Nissin Chemicals Co., Ltd.). Further, a heat-sensitive transfer image-receiving sheet (Z-6) was prepared in the same manner as the heat-sensitive transfer image-receiving sheet (Z-3), except that 37.0 parts by mass of the vinyl chloride-series latex used in the interlayer 2 was reduced to 12.0 parts by mass, and 15.0 parts by mass of a vinyl chloride-series latex having the Tg of 33° C. (trade name, Vinybran 276, manufactured by Nissin Chemicals Co., Ltd.) and 3.0 parts by mass of glycerol were added to the interlayer 2. These heat-sensitive transfer sheets and heat-sensitive transfer image-receiving sheets were used in combination to perform the following measurement and evaluation.

(Measurement and Evaluation)

<Printer>

Various evaluations were conducted by using a high-speed printer ASK2000 manufactured by FUJIFILM Corporation.

An ordinary printing of the printer is performed by successively conducting the following printing operations of (1) to (5):

(1) A yellow dye layer of the heat-sensitive transfer sheet and a receptor layer are superposed, and then a yellow dye is printed on the receptor layer by applying to them heat released from a thermal head.

(2) The heat-sensitive transfer sheet is peeled and moved to superpose a magenta dye layer of the heat-sensitive transfer sheet and the yellow dye-printed portion of the receptor layer, and then a magenta dye is printed on the receptor layer by applying to them heat released from a thermal head.

(3) The heat-sensitive transfer sheet is peeled and moved to superpose a cyan dye layer of the heat-sensitive transfer sheet and the yellow dye and magenta dye-printed portion of the receptor layer, and then a cyan dye is printed on the receptor layer by applying to them heat released from a thermal head.

(4) The heat-sensitive transfer sheet is peeled and moved to superpose a transferable protecting layer of the heat-sensitive transfer sheet and the yellow dye, magenta dye and cyan dye-printed portion of the receptor layer, and then the transferable protecting layer is transferred on the receptor layer by applying to them heat released from a thermal head.

(5) The heat-sensitive transfer sheet is peeled from the heat-sensitive transfer image-receiving sheet to which the dyes and the transferable protecting layer have been transferred, and then the resultant image-receiving sheet is cut to a desired size, and then released from an outlet of the printer to obtain a print.

The line-type thermal head of the aforementioned printer is a loop (folded) electrode type head having 300 dpi, and is arranged at such the position that a flexible platen roller faces the thermal head.

It is noted that the thermal head in the printing operations (1) to (4) is heated by applying energy to a heater of the thermal head, the energy being generated by supplying an electric current to the heater, while applying a driver IC-controlled voltage.

The printing speed of the dye layers was each about 115 mm/sec. and about 0.7 milliseconds per line of the thermal head. The printing time was about 8 sec. at the king size (4 inch×6 inch).

The printer was operated under the room environment of temperature of 23° C. to 26° C. and relative humidity of 45% to 55%.

<Measurement of Contact Distance Between Thermal Head and Heat Resistant Lubricating Layer>

The thermal head previously colored with a heat resistant and weather resistant marker RED (trade name, manufactured by Okitsumo Incorporated) was used. The printing operation was suspended at the time when the aforementioned printing operation (1) has finished. The contact region of the thermal head and the heat resistant lubricating layer was measured according to the method described in the description of the preset application, thereby to obtain the contact distance. As the printer, a printer of the center set point type in terms of a positional relationship between the thermal head and the platen roller was used. Measurements were individually performed with respect to the cases where the energy applied to the thermal head in the printing operation (1) was respectively nothing (0 J/cm$^2$), 0.7 J/cm$^2$, and 2.1 J/cm$^2$. The contact distance corresponding to each of the applied energies was obtained. A longer measured length indicates a longer contact distance between the thermal head and the heat resistant lubricating layer. Further, a difference of the contact distance was obtained by subtracting the contact distance value where the applied energy was nothing (0 J/cm$^2$), from the contact distance value where the applied energy was 0.7 J/cm$^2$.

The surface temperature of the thermal head at the state where the thermal head does not contact the heat resistant lubricating layer was measured. When the applied energy was 0.7 J/cm$^2$, the surface temperature was about 180° C. When the applied energy was 2.1 J/cm$^2$, the surface temperature was about 420° C.

With respect to ordinary prints, no dye was transferred in the case where the applied energy was nothing (0 J/cm$^2$). In contrast, the optical densities of the print samples ranged from 0.25 to 0.45 were obtained in the case where the applied energy was 0.7 J/cm$^2$, and the optical densities of the print samples ranged from 2.2 to 2.4 were obtained in the case where the applied energy was 2.1 J/cm$^2$, respectively.

<Evaluation of Stability to Shift of Head Position>

A printer in which a thermal head has been set so as to shift in the forward direction by 0.1 mm from the center set value against the platen roller, and another printer in which a thermal head has been set so as to shift in the backward direction by 0.1 mm from the center set value against the platen roller, were provided. Still another printer in which a thermal head has been set right in front of the platen roller was provided. Totally, three kinds of printers were used. As the print image, totally fifteen kinds of images were used including five kinds of portraits (human pictures), five kinds of landscape pictures, and gray solid images of (200, 200, 200), (128, 128, 128), (102, 102, 102), (64, 64, 64) and (0, 0, 0) as (R, G, B) value 8 bit digital data. An ordinary printing was performed by using these fifteen kinds of images and three kinds of printers to obtain 45 kinds of single sheet prints. The number of image disappearance having a diameter of 0.5 mm or more was counted with respect to the thus-obtained sheet prints. The frequency of image disappearance per sheet of print was calculated by dividing the number of the image disappearance by the number of sheet print. The thus-obtained numerical value was used as an indicator of stability to the thermal head's position. A smaller value indicates a less occasion of the image disappearance even in the case where the thermal head's position varies, which results in a more stable image.

<Evaluation of Thermal Head Stain>

A printer of a center set value as a relationship in terms of position between the thermal head and the platen roller was used from a viewpoint of the printer's set-up. As a print image, the fifteen images that were used to evaluate stability to shift of head position were used equally. Using both the printer and the image, 1,200 sheet prints were obtained by an ordinary printing. After printing, the thermal head was taken out from the printer, and then the height of a shape (form) profile of the thermal head was measured using Color 3D Profile Microscope VK-9500 GII (tradename, manufactured by KEYENCE Corporation), to evaluate the height of stain attached to the thermal head. The thus-obtained value was defined as a stain on the thermal head. A smaller value indicates a less thermal head stain, so that a scratch on the image and disconnection to the thermal head can be controlled and thereby a time limit in which the thermal head should be exchanged can be prolonged.

Names of each of the heat-sensitive transfer sheets and the heat-sensitive transfer image-receiving sheets that were used in each Example are shown in the following Table 23 together with measurement results and evaluation results that were achieved by them.

TABLE 23

| Examples No. | Heat-sensitive transfer sheet sample name | Heat-sensitive transfer image-receiving sheet sample name | Each of the contact distances at the applied energy (μm) 0 J/cm² | 0.7 J/cm² | 2.1 J/cm² | Difference of the contact distance (μm) | Stability to the head position | Head stain (μm) | Remarks |
|---|---|---|---|---|---|---|---|---|---|
| 1 | T-1 | Z-1 | 305 | 465 | 635 | 160 | 2.3 | 15.8 | Comparative example |
| 2 | T-1 | Z-2 | 275 | 400 | 615 | 125 | 6.2 | 12.3 | Comparative example |
| 3 | T-1 | Z-3 | 305 | 410 | 620 | 105 | 7.3 | 13.1 | Comparative example |
| 4 | T-2 | Z-1 | 310 | 470 | 625 | 160 | 2.5 | 15.6 | Comparative example |
| 5 | T-2 | Z-2 | 300 | 405 | 635 | 105 | 2.4 | 6.3 | This invention |
| 6 | T-2 | Z-3 | 360 | 415 | 625 | 55 | 1.0 | 4.2 | This invention |
| 7 | T-2 | Z-4 | 300 | 370 | 620 | 70 | 1.4 | 5.0 | This invention |
| 8 | T-2 | Z-5 | 260 | 340 | 615 | 80 | 16.2 | 3.8 | Comparative example |
| 9 | T-2 | Z-6 | 370 | 465 | 640 | 95 | 1.6 | 21.8 | Comparative example |
| 10 | T-3 | Z-3 | 310 | 420 | 620 | 110 | 8.5 | 13.1 | Comparative example |
| 11 | T-4 | Z-3 | 310 | 420 | 630 | 110 | 20.5 | 16.7 | Comparative example |

The following facts (matters) are seen from Table 23.

It is seen from Examples 1, 4 and 9, in which each of the contact distances at the applied energy of 0.7 J/cm² was longer than the range of the contact distance according to the present invention, that stability to the head position was excellent, even though the head stain was much. On the other hand, it is seen from Example 8, in which the contact distances at the applied energy of 0.7 J/cm² was shorter than the range of the contact distance according to the present invention, that stability to the head position was poor, even though the head stain was a little.

It is seen from Examples 2, 3, 5-7, 10 and 11, in which each of the contact distances at the applied energy of 0.7 J/cm² was controlled so as to become within the range of the contact distance according to the present invention by adjusting the compositions of the heat-sensitive transfer image-receiving sheets having a water-soluble polymer and a heat insulation layer containing hollow polymer particles, that only in Examples 5-7, in which the image-receiving sheets were used in combination with the heat-sensitive transfer sheet (T-2) according to the present invention, stability to the head position was excellent and at the same time the head stain was a little. In contrast, the contact distance at the applied energy of 2.1 j/cm² does not vary so much among Examples 1 to 11. In the case where the applied energy is 0 J/cm², the contact distance does not accord with the tendency of the achieved performance. From the above-described results, it is understood that the limitation of the contact distances at the applied energy of 0.7 J/cm² is necessary.

When compared to the case where the quantity, hardness, size and shape of the inorganic particles that are contained in the heat resistant lubrication layer of the heat-sensitive transfer sheet are controlled so as to become within the range of the present invention (Examples 5 to 7), it is seen that no improvement effect can be obtained in the case where inorganic particles beyond the limitation of the present invention are used (Examples 2, 3, 10 and 11). Improvement of stability to the head position owing to selection of the inorganic particles is an unexpected effect in view of the previously known matters.

When Example 4 is compared to Example 1, it is seen that the contact distance dose not almost change owing to a difference in the composition of the heat-sensitive transfer sheet in spite of the amount of the applied energy. In contrast, when Example 5 is compared to Example 2 and likewise when Example 6 is compared to Example 3, it is seen that the contact distance at the applied energy of 0 J/cm² can be remarkably lengthened by the particular composition of the heat-sensitive transfer image-receiving sheet, and further by controlling not only the contact distance at the applied energy of 0.7 J/cm² so as to become within the specific range of the present invention, but also the inorganic particles that are contained in the heat resistant lubrication layer of the heat-sensitive transfer sheet so as to fall within the definition of the present invention. It is seen that, by virtue of the contact distance at the applied energy of 0 J/cm² which has become longer, a difference of the contact distance between the applied energies of 0 J/cm² and 0.7 J/cm² is within the range of 40 μm to 100 μm in Examples 6 to 7, so that among the embodiments of the present invention, the embodiments recited in Examples 6 to 7 are more preferable than the embodiment recited in Example 5.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C. §119 (a) on Patent Application No. 2008-019857 filed in Japan on Jan. 30, 2008, which is entirely herein incorporated by reference.

What I claim is:

1. A heat-sensitive transfer image forming method, the method comprising:

providing a heat-sensitive transfer image-receiving sheet having a heat insulation layer and a receptor layer on one surface of a support and a heat-sensitive transfer sheet having a heat-sensitive transfer layer containing a dye on one surface of a support and a heat resistant lubricating layer on another surface of the support; superposing the heat-sensitive transfer image-receiving sheet and the heat-sensitive transfer sheet so that the receptor layer and the heat-sensitive transfer layer contact with each other; making a thermal head contact with the superposed sheets from the heat resistant lubricating layer side; and applying heat from the thermal head to the heat-sensitive transfer sheet, while making the thermal head and the heat-sensitive transfer sheet move at a relative speed of 60 mm/sec. or more, and thereby transferring the dye from the heat-sensitive transfer layer to the receptor layer to form an image;

wherein, in the heat-sensitive transfer image-receiving sheet, the heat insulation layer contains hollow polymer particles, and at least one of the receptor layer and the heat insulation layer contains a water-soluble polymer;

wherein, in the heat-sensitive transfer sheet, the heat resistant lubricating layer contains inorganic particles in an amount of 0.01% by mass to 5% by mass with respect to the total solid content of the heat resistant lubricating layer, wherein the inorganic particles have Mohs' hardness of 3 to 6 and a mean particle size of 0.3 to 5 μm, and the ratio of the maximum width of each of the inorganic particles to the sphere equivalent diameter thereof is from 1.5 to 50; and wherein, when 0.7 J/cm$^2$ of energy is applied to the thermal head, the contact distance between the thermal head and the heat resistant lubricating layer is from 350 to 450 μm.

2. The heat-sensitive transfer image forming method according to claim 1, wherein the difference in the contact distance between the case where 0.7 J/cm$^2$ of energy is applied to the thermal head and the case where none of energy is applied to the thermal head is from 40 to 100 μm.

3. The heat-sensitive transfer image forming method according to claim 1, wherein the heat-sensitive transfer sheet has a thermal transfer layer containing a yellow dye, a thermal transfer layer containing a magenta dye, and a thermal transfer layer containing a cyan dye on the support at a position thereof different from each other, and the print speed of the dye in each of the thermal transfer layers is 80 mm/sec. or more.

4. The heat-sensitive transfer image forming method according to claim 1, wherein the inorganic particle contained in the heat resistant lubricating layer is magnesium oxide.

* * * * *